US006092317A

United States Patent [19]

Volkert

[11] Patent Number: 6,092,317

[45] Date of Patent: Jul. 25, 2000

[54] POP-UP ITEMS HAVING PRESSURE-SENSITIVE ADHESIVE

[75] Inventor: John K. Volkert, Northfield, Ill.

[73] Assignee: Papermasters, Inc., Northfield, Ill.

[21] Appl. No.: 08/970,903

[22] Filed: Nov. 14, 1997

Related U.S. Application Data

[63] Continuation-in-part of application No. 08/418,943, Apr. 7, 1995, Pat. No. 5,687,495.

[51] Int. Cl.[7] ..... G09F 1/00

[52] U.S. Cl. ..... 40/124.08; 40/124.09; 446/148; 428/42.3

[58] Field of Search ..... 40/124.08, 124.11, 40/124.14, 124.16, 124.191, 539, 594, 630, 638; 446/148, 150; 428/41.8, 42.3; 283/117

[56] References Cited

U.S. PATENT DOCUMENTS

| | | | |
|---|---|---|---|
| 1,841,041 | 1/1932 | Lowenstein | 40/539 |
| 2,099,420 | 11/1937 | Cloud | 40/539 |
| 2,632,269 | 3/1953 | Sanders | 40/594 |
| 4,146,983 | 4/1979 | Penick et al. | 40/124.1 |
| 4,454,180 | 6/1984 | LaMers | 428/42.3 |
| 4,592,573 | 6/1986 | Crowell | 283/56 |
| 5,022,681 | 6/1991 | Penick | 40/124.08 X |
| 5,041,072 | 8/1991 | McClelland | 493/188 |
| 5,181,901 | 1/1993 | Volkert | 493/331 |
| 5,404,665 | 4/1995 | Choi | 40/630 |
| 5,687,495 | 11/1997 | Volkert | 40/124.08 |

*Primary Examiner*—Brian K. Green
*Attorney, Agent, or Firm*—Fitch, Even, Tabin & Flannery

[57] ABSTRACT

To provide pop-up items a plurality of individual sheet material structures are die-cut in composite sheet material consisting of a front sheet and a rear liner sheet of release-coated material joined together by having a pressure-sensitive adhesive (PSA) pattern between the rear surface of the front sheet and the front surface of the rear liner sheet so that, upon separating the sheets, PSA releases from the release-coated rear sheet and adheres to the front sheet in at least desired regions. Some pop-up structures are formed with two generally symmetrical halves arranged about a fold-line. A folded structure results from the superimposition of one-half of the structure onto the other constituting a pop-up element in which two individual flag panels are joined together, as by being affixed to each other by PSA and in which there are at least two subpanels having exposed PSA-covered surfaces. When the pop-up element is placed between a pair of facing panels of a folded basepiece, the PSA-carrying subpanels become affixed to facing surfaces of the folded basepiece, and upon pivoting of the basepiece panels to the open position, the pop-up element assumes an attention-attracting, 3-dimensional configuration.

8 Claims, 10 Drawing Sheets

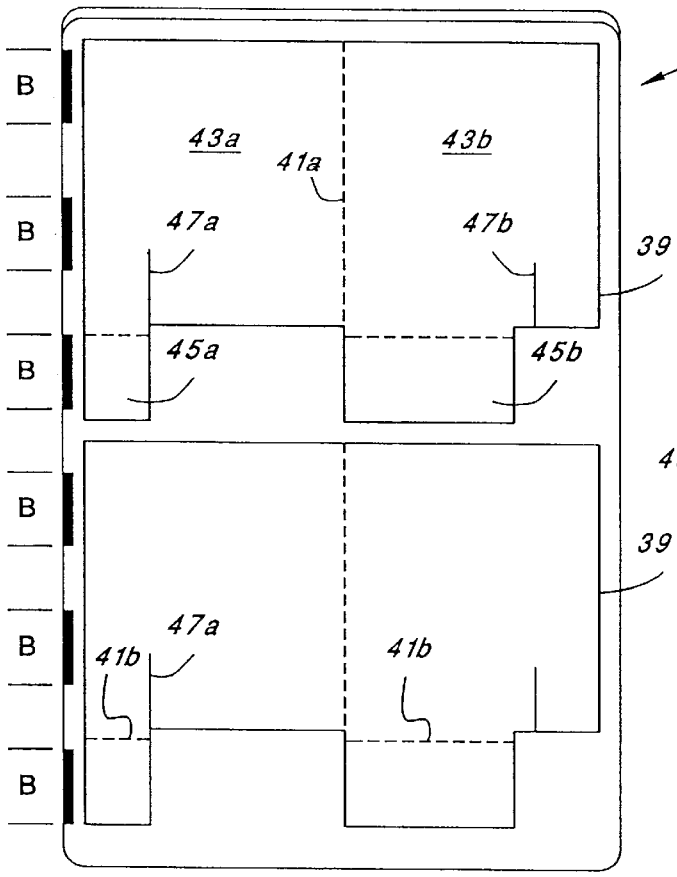
FIG. 7
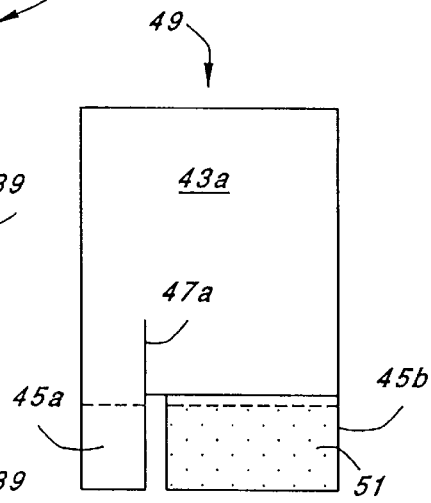
FIG. 9
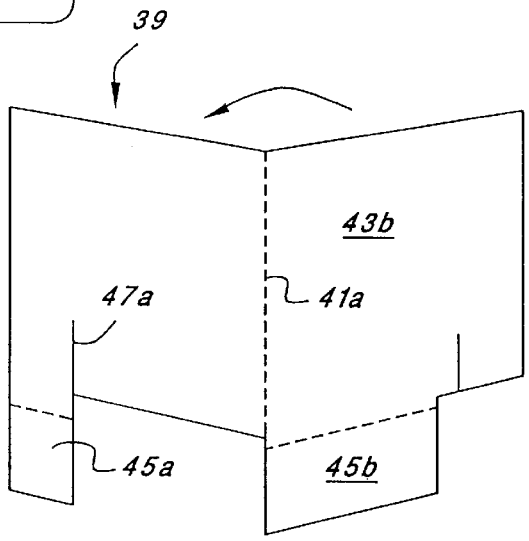
FIG. 8
FIG. 10
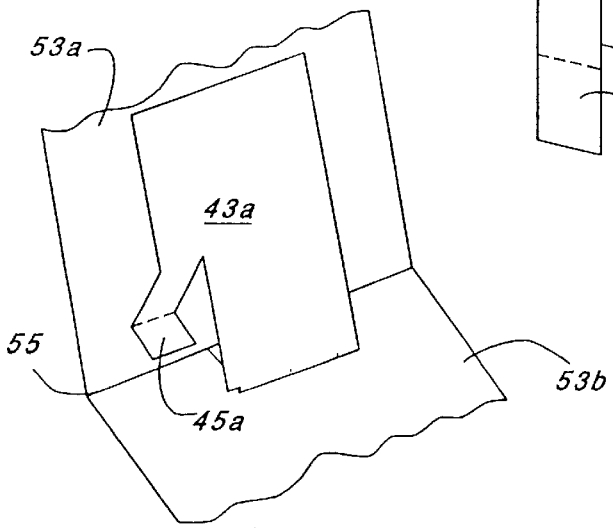

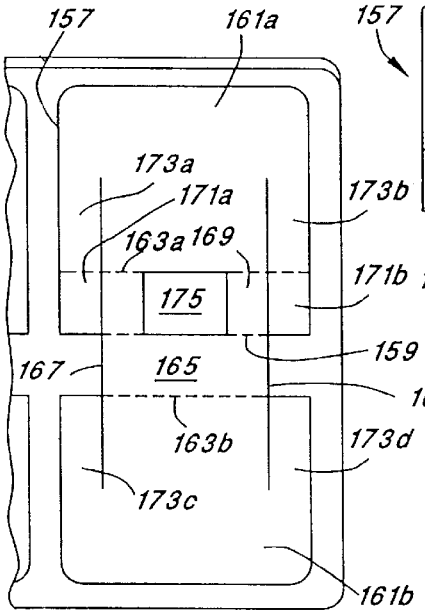
FIG. 31
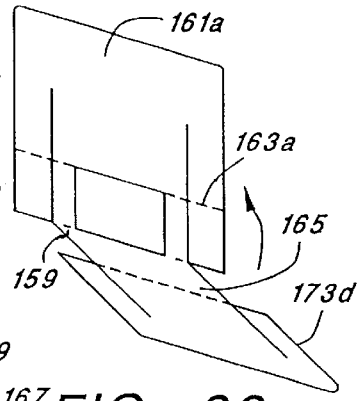
FIG. 32
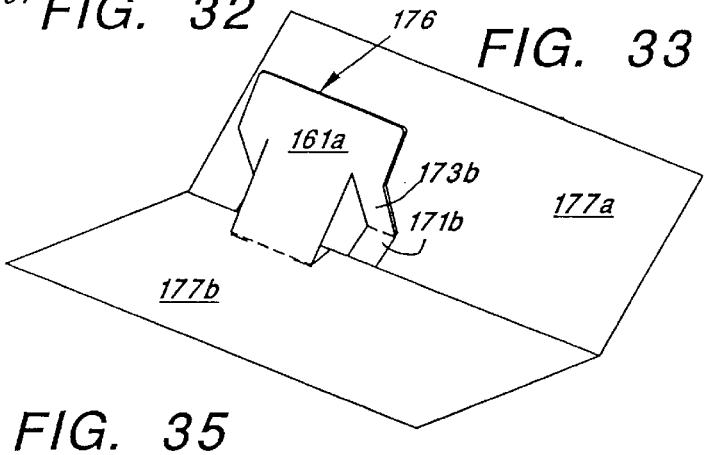
FIG. 33
FIG. 34
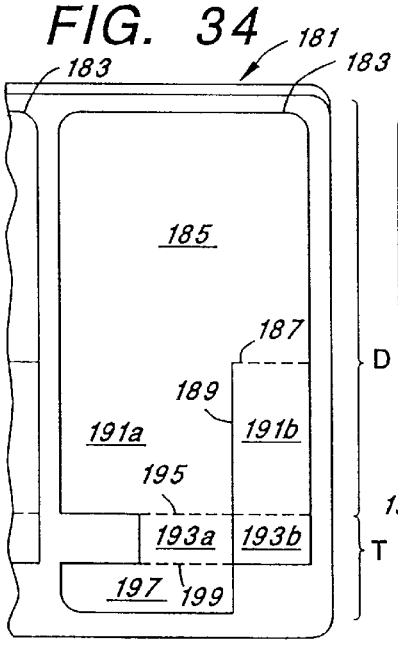
FIG. 35
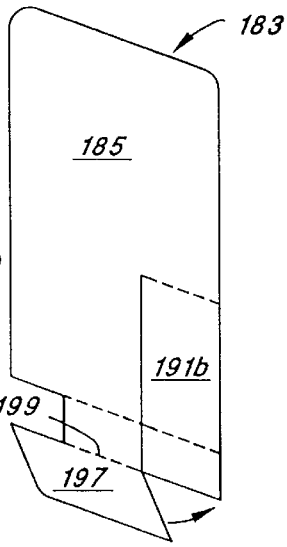
FIG. 38
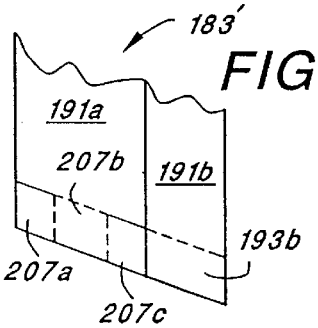
FIG. 37
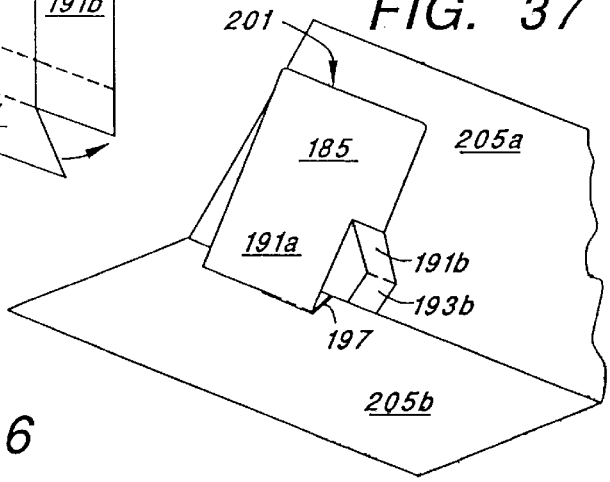
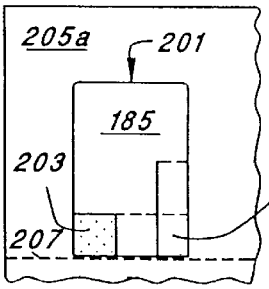
FIG. 36

POP-UP ITEMS HAVING PRESSURE-SENSITIVE ADHESIVE

This application is a continuation-in-part of application Ser. No. 08/418,943, filed Apr. 7, 1995, now U.S. Pat. No. 5,687,495, issued Nov. 18, 1997. This parent application is incorporated herein by reference.

This invention relates generally to novelty items made of paper or other sheet material having pressure-sensitive adhesive for affixing such item in operative position and more particularly to items of this type which can be fabricated without the use of sophisticated manufacturing equipment.

BACKGROUND OF THE INVENTION

Pop-ups have fairly recently become frequently used in advertising and in other promotional endeavors and as novelty items to either attract attention or simply for purposes of decoration. Whereas many of these pop-up items were developed for use in mass direct-mail solicitations and the like, they have recently become of commercial interest in a form where strategically located areas of pressure-sensitive adhesive permit the simple placement of the pop-up by the recipient in an attention-attracting location. Examples of such pressure-sensitive adhesive-bearing pop-ups are shown in U.S. Pat. No. 5,078,670 issued Jan. 7, 1992, No. 5,181,901, issued Jan. 26, 1993, and No. 5,346,455 issued Sep. 13, 1994. A variation of such pop-up items is shown in U.S. Pat. No. 4,592,573, see FIGS. 6–17.

These patents variously show pop-up items which are fabricated by the application of adhesive, both pressure-sensitive adhesive and bonding or permanent adhesive, to selective locations on a web in order to facilitate the mass production of such pop-up items. Generally, the fabricating methods shown utilize the application of release coatings or release liner materials to selectively interface with and/or protect the pressure-sensitive adhesive regions in the fabricated product. Accordingly, many of these embodiments require relatively sophisticated fabrication equipment to permit their efficient manufacture. Accordingly, improved pop-up designs have continued to be sought to simplify such manufacture.

SUMMARY OF THE INVENTION

Improved pop-up constructions are herein provided for the fabrication of pop-up elements having exterior surfaces which carry pressure-sensitive adhesive. It has been found that pop-up items can be designed so that production can be carried out by simply kiss-cutting composite sheet material which comprises a front sheet held by an overall pressure-sensitive adhesive pattern to a rear liner sheet, enabling them to be efficiently mass-produced at high speed. The overall pressure-sensitive adhesive pattern can completely cover the rear surface of the front sheet, as is commonly done in sheets of pressure-sensitive labels designed for use as a roll or as individual sheets for preparing address labels or the like using the electronic data processing (EDP); for example, 8½×11 sheets of multiple rectangular labels that are provided for printing sheets of mailing address labels, using laser printers attached to computers, can be kiss-cut to create pop-up items.

More specifically, the composite sheet is die-cut by kiss-cutting to create a planar pop-up structure in the front sheet that is divided into two halves which are generally symmetrical about a central fold-line and which, upon folding, provide a flag unit and at least two interconnected subpanels which have pressure-sensitive adhesive on exposed surfaces thereof and which are strategically located so as to support the flag unit in its desired operative, attention-attracting, 3-dimensional orientation. Alternatively, such adhesive pattern need not be complete; instead it could be provided in any regular pattern such that, by registration of the location of the pop-up structure on the front sheet, the pressure-sensitive regions will be strategically located to provide the desired exposed pressure-sensitive regions at key locations, i.e. on supporting subpanels, and to also appropriately join certain flag sections to one another in the finished product to create the flag unit.

BRIEF DESCRIPTION OF THE DRAWINGS

FIG. 4 is a view of the pop-up element shown in FIG. 3 folded again in one-half about a central line so as to ready it for placement upon a basepiece or the like.

FIG. 7 is a view similar to FIG. 1 of a composite sheet in which there has been die-cut a plurality of pop-up structures of an alternative design which also embody various features of the invention.

FIG. 8 is a view similar to FIG. 2 showing a pop-up structure from FIG. 7 after it has been removed from the rear liner sheet and as it is being folded upon itself about a central vertical fold-line.

FIG. 9 is a front view of the pop-up element of FIG. 8 after folding is completed.

FIG. 10 is a view similar to FIG. 6 showing the pop-up element of FIG. 9 after it has been placed between a pair of folded basepieces, with the folded basepieces being opened so as to cause the pop-up element to assume its 3-dimensional configuration.

FIG. 31 is a perspective view similar to FIG. 20 showing still another alternative embodiment of a pop-up item of composite sheet material which contains a plurality of pop-up structures.

FIG. 32 is a perspective view of a pop-up structure of FIG. 31 removed from the liner sheet and shown as it is being folded about a horizontal fold-line.

FIG. 33 is a perspective view showing the pop-up element, created by the folding step of FIG. 32, in operative position between a pair of folded basepieces that are being opened.

FIG. 34 is a perspective view showing still another alternative embodiment of a pop-up item made of composite sheet material bearing some similarity to that of FIG. 31 but made with two different types of adhesive, with a dry residue adhesive located in the region of the flag sections and with a pressure-sensitive adhesive located in the lower regions.

FIG. 35 is a perspective view, similar to FIG. 32, showing the pop-up structure of FIG. 34 with the lowest subpanel being folded rearward about a horizontal fold-line.

FIG. 36 is a fragmentary front view showing the pop-up element, formed in FIG. 35, located in place on a basepiece having a horizontal fold-line.

FIG. 37 is a perspective view showing the arrangement of FIG. 36 following subsequent folding of the basepiece and then unfolding so that the pop-up element assumes an attention-attracting 3-dimensional orientation.

FIG. 38 is a fragmentary perspective view generally similar to FIG. 35 showing a modification of the structure illustrated in FIG. 35.

DETAILED DESCRIPTION OF THE PREFERRED EMBODIMENTS

Figure 1:
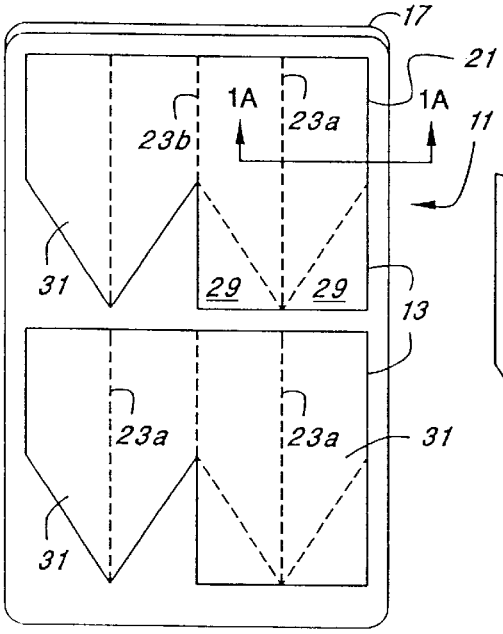
FIG. 1 is a top perspective view of a composite sheet having a plurality of pop-up structures embodying various features of the invention die-cut in the front sheet thereof and having an overall pattern of pressure-sensitive adhesive completely covering the rear surface of the front sheet.
Figure 1A:
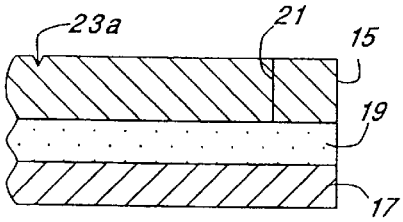
FIG. 1A is a fragmentary sectional view, enlarged in size, taken generally along lines 1A—1A of FIG. 1.

Illustrated in FIG. 1 is a pop-up item 11 which has been fabricated to provide a plurality of planar pop-up structures 13. In this instance, for purposes of illustration, two pop-up structures 13 are shown; however, it should be understood that a dozen or more pop-up structures could be provided in a larger composite sheet. The pop-up item 11, as best seen in FIG. 1A, includes a front or top sheet 15 which is generally coextensive with a rear liner sheet 17. These 2 sheets are held together in face-to-face contact by a layer of pressure-sensitive adhesive 19 that is applied to one of the sheets as an overall pattern. For purposes of simplicity, the overall pattern can be one of complete coverage of the rear surface of the sheet 15; however, as explained hereinafter, the pattern could be any substantially regular pattern covering predetermined regions of the sheet so that the outlines of the pop-up structures 13 can be appropriately registered with such a less than complete adhesive pattern to obtain the desired result.

The sheet material is preferably a suitable paper or paperboard material, glossy or matte finish as desired, but could alternatively be an appropriate, thin, flexible fabricated material, e.g. thermoplastic. A pressure-sensitive adhesive 19 is chosen that will retain a high tack so it can be affixed to either porous or nonporous surfaces and so that it will also adhere when folded upon itself. Such adhesives are readily available from adhesive formulators throughout the United States and are well known to those having ordinary skill in this art. Such adhesive materials can be applied using conventional coating material, either as a complete coverage pattern or as an overall pattern that is interrupted in a desired but regular manner which will then allow registration between the location of the pop-up structures in the first sheet and the adhesive pattern in order to have pressure-sensitive adhesive covering certain functional surfaces of the ultimate pop-up element.

The composite sheet is appropriately die-cut to create the plurality of pop-up structures 13 preferably using a kiss-cutting arrangement such as is well known in this art. More specifically, kiss-cutting effects a severing which extends completely through the front sheet or the web 15 but which does not extend into the rear sheet 17.

The rear sheet 17 can be any suitable sheet material having a release surface to which the pressure-sensitive adhesive does not strongly adhere so that it can be easily separated therefrom. It can be fibrous or paper material coated with a release coating, usually a silicone, or it can be a thin plastic material. Generally, any of the materials such as are well known from the pressure-sensitive label art can be employed.

Depicted in FIG. 1A is a kiss-cut slit 21 which extends completely through the top sheet 15 and forms a part of the outline of the pop-up structure 13. The kiss-cutting operation can also provide lines of weakness 23 in the front sheet at predetermined locations, and one such line of weakness 23*a* is shown in FIG. 1A.

Figure 3:
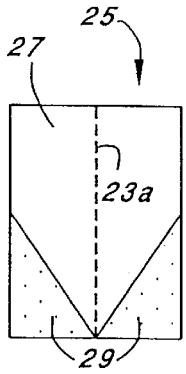
FIG. 3 is a view, reduced in size, showing the pop-up element following folding where a pair of triangular subpanels can be seen which have pressure-sensitive adhesive on the exposed surfaces thereof.

The pop-up structure 13 is designed to create a pop-up element 25, as shown in FIG. 3, which consists of a flag unit 27 and a pair of interconnected supporting subpanels 29 which are of triangular shape. To create this desired ultimate structure, the pop-up structure 13 is designed with a pair of generally symmetrical halves that are interconnected with each other along a vertical fold-line 23*b*. Generally, each half of the pop-up structure has a flag section 27 of substantially the same size and shape, the lowermost edges of which form an angle of about 70 to 120°. Only the right-hand half of the pop-up structure includes the supporting subpanels 29 which are attached to the flag section via lines of weakness. Centrally located in each of the flag sections 27 are vertically extending lines of weakness 23*a*.

Figure 5:
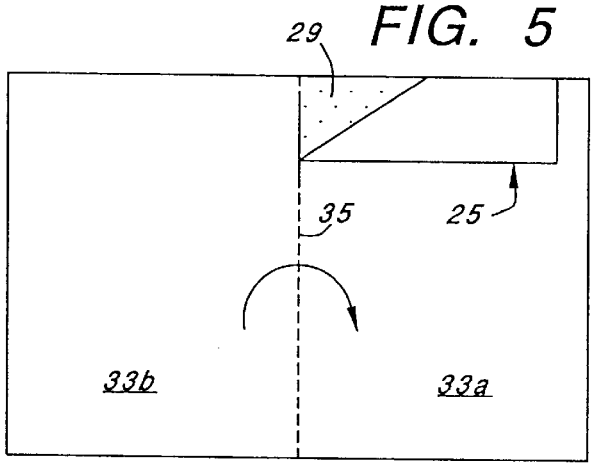
FIG. 5 is a view of the FIG. 4 pop-up element in place along the center fold-line and the upper edge of a two-panel basepiece that is then folded over to superimpose the two panels.
Figure 4:
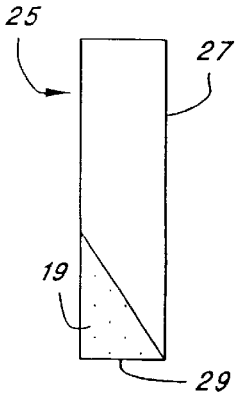
Figure 6:
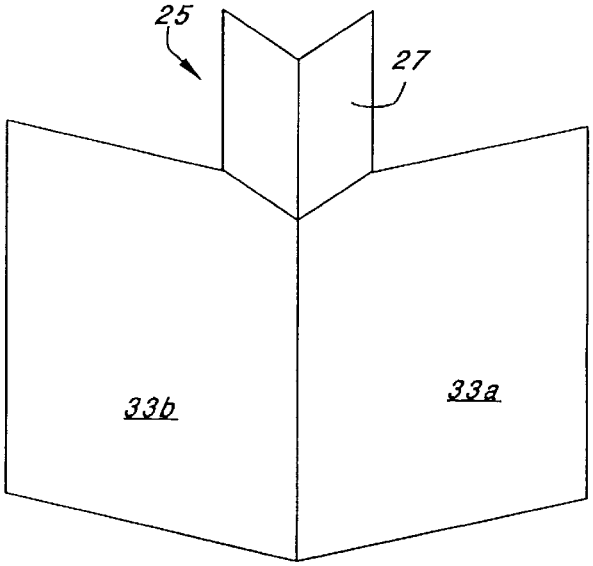
FIG. 6 is a perspective view showing the arrangement of FIG. 5 following subsequent unfolding of the basepiece wherein the pop-up element assumes an attention-attracting 3-dimensional orientation.

When the pop-up structure 13 is removed from the composite sheet and then folded rearwardly about the central vertical line of weakness 23*b* to bring the adhesive-covered rear surfaces of the flag sections 31 into juxtaposition with each other to create the flag unit 27, the alignment is such that all of the adhesive in this region is sandwiched between the two flag sections 31, leaving as the only pressure-sensitive adhesive 19 exposed that which covers the supporting subpanels 29, as best seen in FIG. 3, and thereby creating the pop-up unit 25. To ready the pop-up unit 25 for use, it is again folded in half about the now central fold-lines 23*a* to create the configuration shown in FIG. 4, which is ready to be applied to an appropriate location on the panel 33*a* of a two-panel basepiece having a central fold-line 35 (FIG. 5). When the opposite panel 33*b* of the basepiece is folded along the line of weakness 35 to sandwich the pop-up element 25 therebetween, an upper triangular region of the panel 33*b* becomes affixed via the pressure-sensitive adhesive to the upward-facing subpanel 29, thus securing the pop-up element 25 in its functional position sandwiched between the panels of the folded basepiece 33. When the panels 33*a* and 33*b* are opened as depicted in FIG. 6, the flag unit 27 assumes a 3-dimensional, attention-attracting orientation between the two subpanels where it will display a printed message that can be appropriately applied to the surface of the left-hand portion of the flag section 31 as arranged in FIG. 1.

Figure 2:
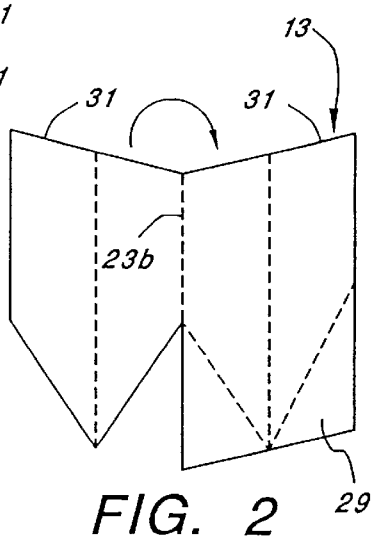
FIG. 2 is a perspective view showing one of the pop-up structures from FIG. 1 being folded about a central fold-line.

Instead of arranging the pop-up structure 13 as shown in FIGS. 1 and 2, it should be understood that an equivalent pop-up structure could be provided by essentially splitting either the right-hand section or the left-hand section in half along the line of weakness 23*a* and relocating the other half of that section so that it is hinged along the other lateral edge of the structure. As for example, focusing upon FIG. 2, only half of the right-hand panel would remain hinged along the hinge line 23*b*, and its mirror image would be similarly hinged along the other edge. Once both of these half sections have been rotated 180°, the resultant structure would look the same as shown in FIG. 3.

Illustrated in FIG. 7 is an alternative embodiment of a pop-up item 37 which is also formed from a composite sheet so as to have a pair of pop-up structures 39 die-cut in the upper or front surface thereof. Each pop-up structure 39 includes a pair of generally symmetrical halves arranged about a vertical line of weakness 41*a*. Each half includes a flag section 43*a*, 43*b* and a depending subpanel 45*a*, 45*b*. The subpanels 45*a,b* are defined at their upper edges by lines of weakness 41*b*. The flag sections include vertical slits 47*a,b* which respectively divide the lower portion of each flag section into a pair of depending legs, one leg of each pair having a subpanel 45 at its lower end.

When the pop-up structure 39 is removed from the pop-up item 37, the pressure-sensitive adhesive adheres to its rear surface inasmuch as the underlying liner sheet is coated with a release coating or the like. The pop-up structure 39 is then folded, as illustrated in FIG. 8, about the central vertical line of weakness 41*a* so that the two halves are superimposed one atop the other with the flag sections 43*a*,b in alignment with each other and with the vertical slits 47*a,b* also being aligned. As a result, a pop-up unit 49 is formed, as depicted in FIG. 9, wherein the lower leg subpanels have pressure-sensitive adhesive 51 on oppositely facing exposed surfaces. Although it is preferable to completely coat the rear surface of the front sheet, alternative regular patterns of coating with pressure-sensitive adhesive can be employed. For example, spaced-apart horizontal bands of a width B can be provided either on the rear surface of the front sheet, or on the front surface of the liner sheet, as illustrated in FIG. 7, rather than coating the complete surface. The kiss-cutting to create the pop-up structures 39 is suitably registered with this pattern, which can be accomplished easily by suitably marking the edge of the roll or web of composite material so that the subpanels 45 will be located in regions of pressure-sensitive adhesive and so that there will also be some pressure-sensitive adhesive in the regions of the flag sections so as to effect the permanent joinder thereof.

The pop-up unit 49 shown in FIG. 9 is ready for insertion onto a panel of a 2-panel basepiece, for example one having panels 53*a* and 53*b* which are hinged together along a central fold-line 55. With respect to the embodiment shown in FIG. 10, the pop-up unit is inserted so that it lies atop the panel 53*a* so that the pressure-sensitive adhesive on the exposed surface of the smaller subpanel 45*a* creates joinder thereto. Thereafter, folding of the basepiece panels so that the panels 53*a* and 53*b* sandwich the pop-up element 49 therebetween effects joinder of the subpanel 45*b* to the surface of the panel 53*b* via the pressure-sensitive adhesive 51. When the folded basepieces are then opened, the pop-up element 49 assumes an attention-attracting 3-dimensional shape as the two depending legs are pulled in opposite directions as a result of their respective attachments to the basepiece panels 53*a*, 53*b* via the subpanels, causing the flag unit to rise up out of the plane of the basepieces and with the flag section 43*a* prominently displayed. One of the advantages of such construction is that both surfaces of such a flag unit can be printed or imaged in the laminated sheet form by imaging only one side of a sheet or web. Moreover, instead of locating both of the subpanels 45*a*, 45*b* attached to separate flag panels, both could alternatively be hinged to a single flag panel, in which case one subpanel would be folded to lie against the flag panel before installing.

Figure 11:
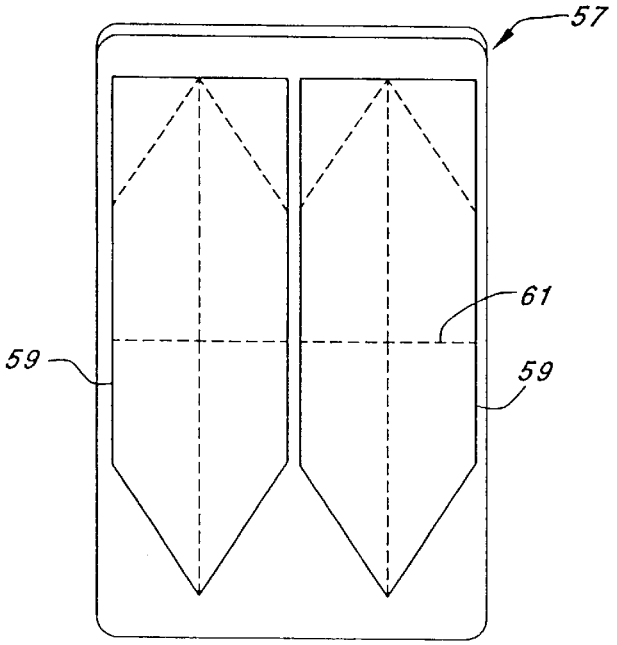
FIG. 11 is a view similar to FIG. 1 wherein a plurality of similar pop-up structures are constructed so that they are generally symmetrical about a horizontal fold-line, as opposed to a vertical fold-line.
Figure 12:
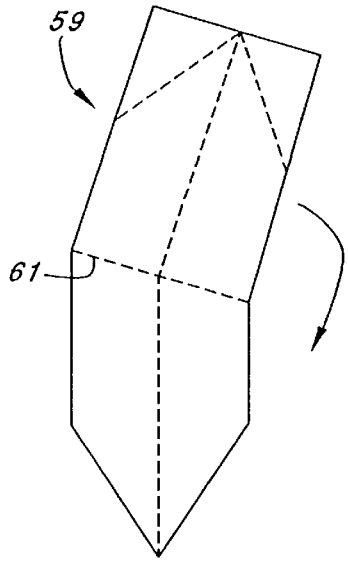
FIG. 12 is a perspective view of one of the pop-up structures from FIG. 11 shown as it is being folded to produce an operative pop-up element which functions exactly the same as that shown in FIG. 3.

Depicted in FIG. 11 is an alternative embodiment of the pop-up item 11 illustrated in FIG. 1. A pop-up item 57 is shown wherein a pair of pop-up structures 59 have been die-cut wherein the generally symmetrical halves are arranged about a horizontal line of weakness 61. When one of the pop-up structures 59 is removed from the composite sheet and folded about the horizontal line of weakness 61 as depicted in FIG. 12, a pop-up element is obtained which is substantially the same as the pop-up element 25 illustrated in FIG. 3, and which functions in exactly the same way.

Figure 13:
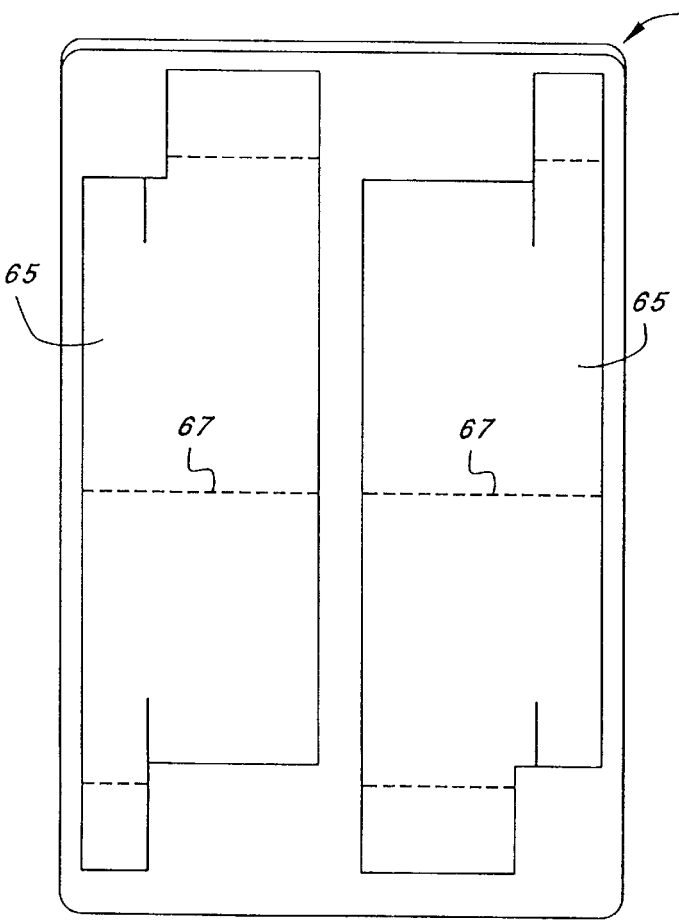
FIG. 13 is a view similar to FIG. 7 showing an alternative construction of pop-up structures similar to those shown in FIG. 7 which are designed so as to be generally symmetrical about a horizontal fold-line as opposed to a vertical fold-line.
Figure 14:
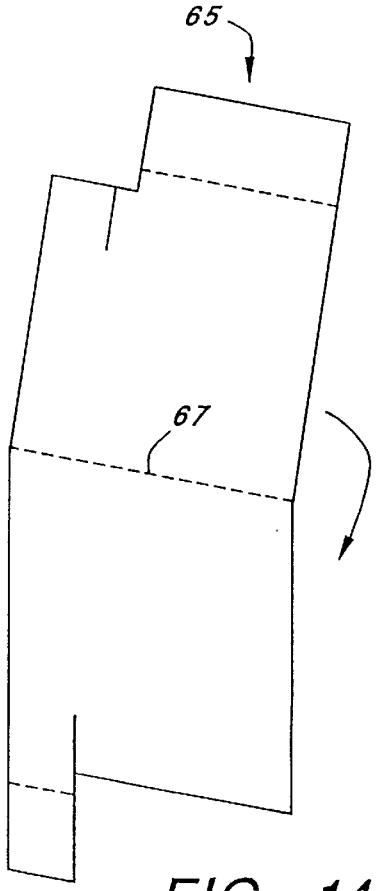
FIG. 14 is a perspective view of one of the pop-up structures from FIG. 13 shown as it is being folded about the horizontal fold-line into its operative configuration which is substantially the same as that shown in FIG. 9.

Illustrated in FIG. 13 is a pop-up item 63 having die-cut in the top or front sheet of the composite sheet a pair of pop-up structures 65 which are the equivalent of the pop-up structures 39 depicted in FIG. 7 but which are arranged so as to be generally symmetrical about a horizontal line of weakness 67. As shown in FIG. 14, when the left-hand pop-up structure 65 is removed from the pop-up item 63 and folded about the line of weakness 67, a pop-up element is obtained which is substantially the same as the pop-up element 49 illustrated in FIG. 9 and which functions in exactly the same manner.

Figure 15:
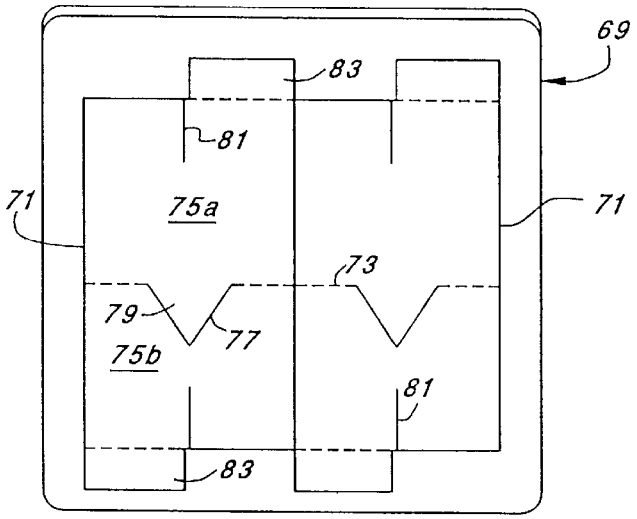
FIG. 15 is a view similar to FIG. 7 showing a pop-up item which is die-cut to form a plurality of pop-up structures of yet another alternative construction embodying various features of the invention, which resemble the structures of FIG. 13 but which are designed to present a business card or the like in attention-attracting orientation.

Illustrated in FIG. 15 is a pop-up item 69 having die-cut (kiss-cut) therein a pair of pop-up structures 71 which are generally an alternative embodiment of the pop-up structures 65 depicted in FIGS. 13 and 14. Similar to the structure 65 shown in FIG. 13, the pop-up structures 71 have formed therein pairs of flag sections 75*a*, 75*b* arranged about a horizontal line of weakness 73; however, in this instance, it is interrupted centrally by a V-shaped die-cut 77 that creates a projection 79 that extends into the lower flag section 75*b*. Vertical slits 81 are provided in the portions of the flag sections 75 spaced from the line of weakness 73 to create pairs of legs, with alternate legs having subpanels 83 formed at the ends thereof.

Figure 16:
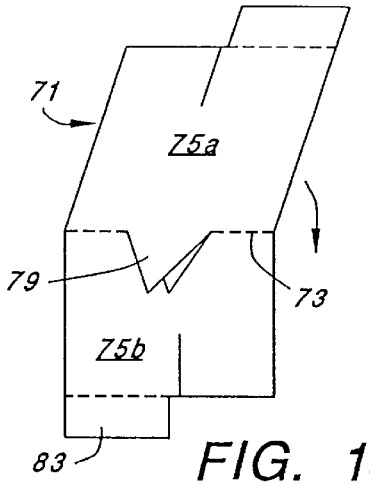
FIG. 16 is a perspective view showing one of the pop-up structures of FIG. 15, removed from the rear liner sheet as it is being folded into its operative configuration.
Figure 17:
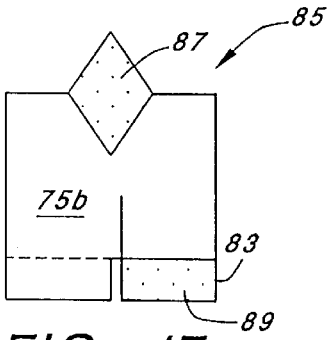
FIG. 17 is a front view of the pop-up unit of FIG. 16 following the completion of folding.

When one of the pop-up structures 71 is removed from the composite sheet and folded, as shown in FIG. 16, about the line of weakness 73, the rear surfaces of the flag sections 75*a*, 75*b* become attached to each other, forming a pop-up element 85 in which the flag unit has an exposed diamond-shaped surface 87 which carries pressure-sensitive adhesive, best seen in FIG. 17. As in the pop-up elements formed from the pop-up items 37 and 63 illustrated in FIGS. 7 and 13, the subpanels 83 have oppositely facing surfaces which carry exposed pressure-sensitive adhesive 89. As mentioned hereinbefore, both subpanels 83 could be hinged to the same flag panel, if desired, with one being folded back to appropriately align the exposed pressure-sensitive adhesive surface prior to installation.

Figure 18:
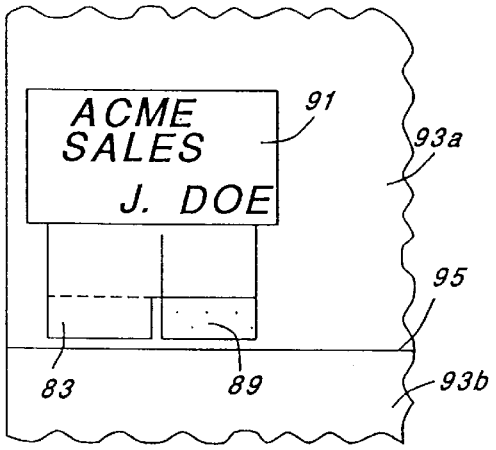
FIG. 18 is a fragmentary view showing the pop-up unit of FIG. 17 with a business card attached thereto placed adjacent the fold-line on a basepiece having at least two panels.
Figure 19:
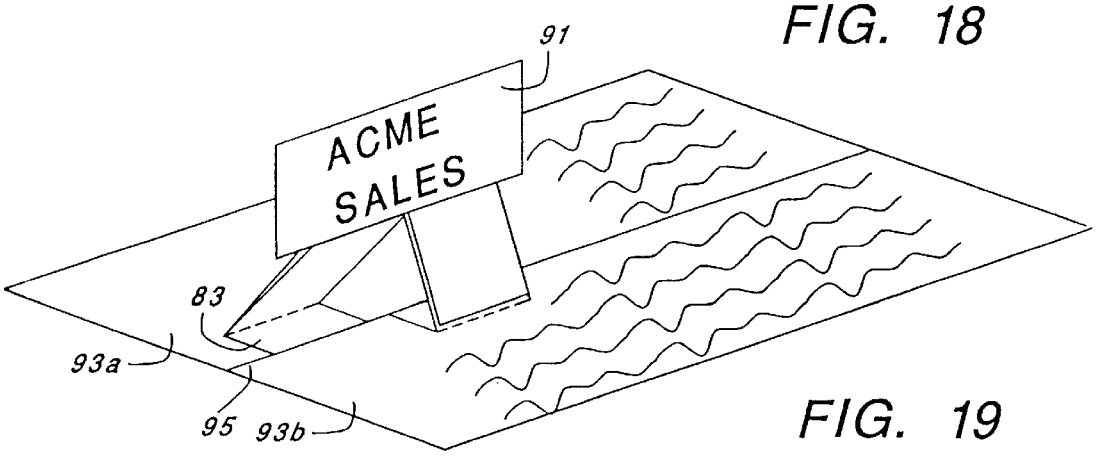
FIG. 19 shows the basepiece, following initially folding about the pop-up unit and the business card of FIG. 18 to sandwich them therebetween, after it has thereafter been opened by the ultimate recipient.

The exposed diamond-shaped adhesive surface 87 allows the quick and easy attachment of a business card 91 or the like to the upper regions of the flag unit as shown in FIG. 18, and if desired, the lower portion of the flag section 75*b*, including the right-hand leg as seen in FIG. 18, can be imprinted with a message while it is still in the form of the pop-up item 69. The pop-up element 85 with the business card 91 attached is placed onto a panel 93*a* of a two-panel basepiece at a location near what will become a fold-line 95, and the panels 93*a* and 93*b* are then folded to sandwich the assembly therebetween as described previously. Opening of the basepiece panels 93*a* and 93*b* causes the pop-up element 85 to assume its 3-dimensional, attention-attracting orientation, presenting the business card 91 prominently to the recipient, as shown in FIG. 19.

It should also be understood that if desired, rather than simply inserting the pop-up element between a pair of facing panels of a folded basepiece, with its lower edge adjacent the fold-line, the subpanels 83 could be folded first along the lines of weakness onto the adjacent legs of the flag sections with the adhesive covered surface of course facing outward. The pop-up element 85 is then similarly inserted between the facing panels but is located a distance from the fold-line 95 approximately equal to the height of the subpanels 83. When the folded basepiece is then opened, the pop-up element assumes substantially the same configuration;

however, instead of being hidden, the surfaces of the subpanels 83 are displayed and could therefore contain additional printed material complementary with that carried by the leg portions of flag sections.

Figure 20:
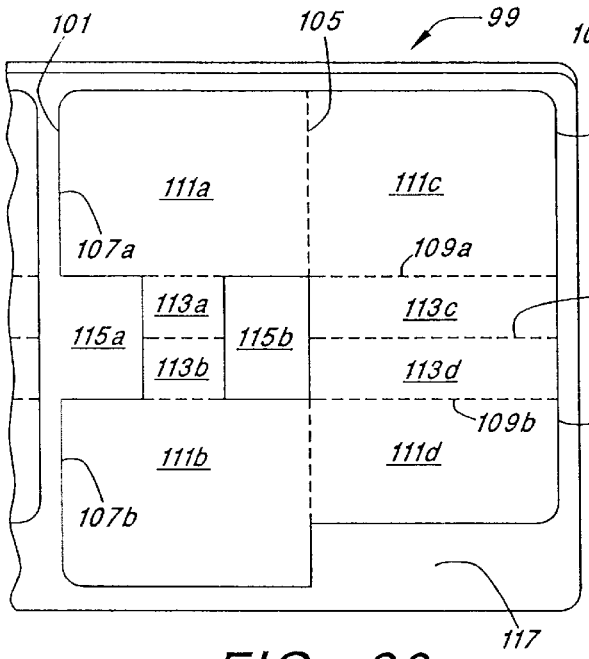
FIG. 20 is a top perspective view of still another pop-up item of composite sheet material comprising a front sheet having pop-up structures die-cut therein, adhered to a rear liner sheet via an overall pressure-sensitive adhesive pattern.

Illustrated in FIG. 20 is a pop-up item 99 in the form of an elongated strip having pop-up structures 101 formed in the front sheet of composite sheet material; however, it should be understood that this arrangement could be produced with multiple pop-up structures abreast in a single 8½×11 sheet or in a continuous web of sheet material, as described hereinbefore, if desired. As with the previously described embodiments, the pop-up structure 101 is kiss-cut in the front sheet of the composite sheet material, and its design is such that there is general symmetry about a horizontal line of weakness 103; however, the structure is also divided into halves by a vertical line of weakness 105. Thus, the lines of weakness 103, 105 create two front quadrants 107*a* and 107*b*, and two rear quadrants 107*c* and 107*d*. In addition, lines of weakness 109*a* and 109*b* extend across the pop-up structure 101 parallel to horizontal line of weakness 103 and preferably spaced equally therefrom. As a result, these lines of weakness 109 divide the quadrants 107 into flag panels 111 and subpanels 113. In addition, a pair of rectangular apertures 115*a* and 115*b* are die-cut in the region of the subpanels of the front quadrants, extending from line of weakness 109*a* to line of weakness 109*b*, and a cutout 117 is provided along an edge of one rear flag panel, in a region spaced from the horizontal line of weakness 103.

Figure 21:
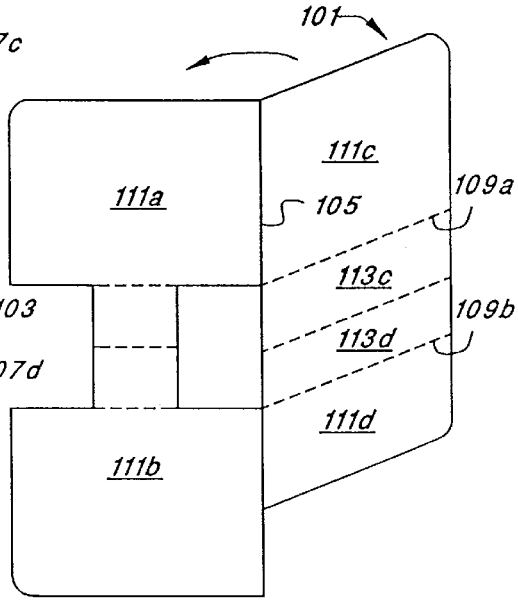
FIG. 21 is a view of a pop-up structure of FIG. 20 removed from the liner sheet, shown as it is being folded about a first vertical fold-line.

Removal of the pop-up structure 101 from the rear sheet of the composite sheet material provides the single thickness sheet shown in FIG. 21 which is first folded in half along the vertical line of weakness 105. A pressure adhesive pattern covers the entire rear surface of the pop-up structure 101. When the folding is complete so that the rear surfaces of the 4 quadrants are in contact with one another, the adhesive affixes flag panel 111*a* to flag panel 111*c* and flag panel 111*b* to flag panel 111*d*, and at the same time, the subpanels 113*a* and 113*b* are respectively joined to subpanels 113*c* and 113*d* to create the once-folded structure depicted in FIG. 22 wherein pressure-sensitive adhesive 119 is exposed in the subpanel regions as a result of the presence of the rectangular apertures 115*a,b*. There is also a region of exposed pressure-sensitive adhesive on the rear surface of the lower edge of flag panel 111*b*, as seen in FIG. 22, because of the provision of the cutout 117.

Figure 22:
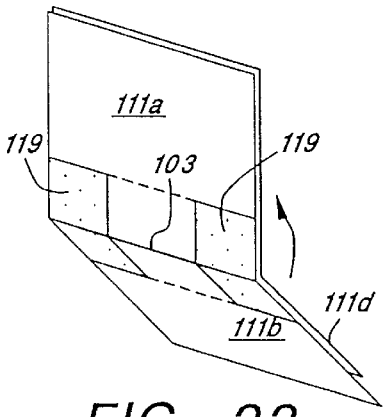
FIG. 22 is a perspective view showing the once-folded pop-up structure of FIG. 21 as it is being folded a second time about a horizontal fold-line.
Figure 23:
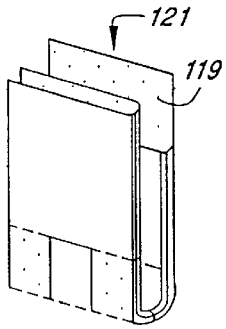
FIG. 23 is a perspective view of the pop-up element following the folding step of FIG. 22, exaggerated to show the relationship before the superimposed surfaces are finally pressed together.
Figure 24:
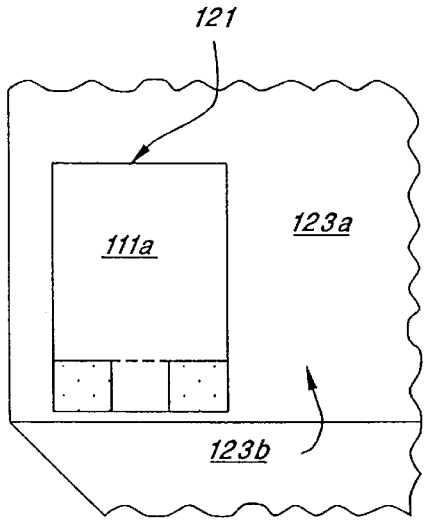
FIG. 24 is a front view showing the folded pop-up element of FIG. 23 placed in operative position adjacent a fold-line on a basepiece having a pair of interconnected panels.
Figure 25:
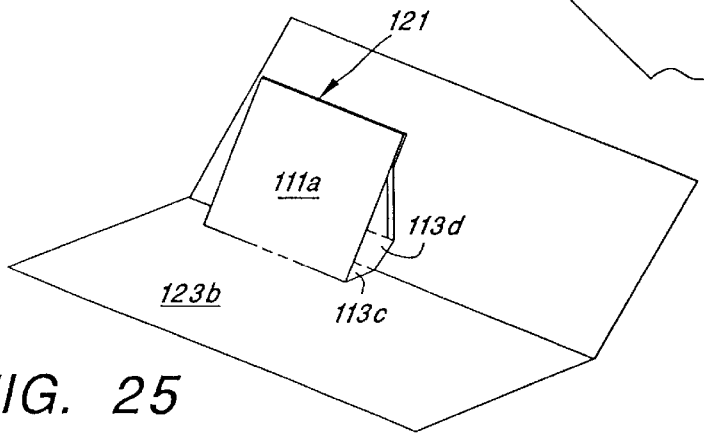
FIG. 25 is a perspective view showing the open panels of the basepiece of FIG. 24 after they were initially folded to sandwich the pop-up element therebetween, which illustrates how the pop-up element assumes an attractive 3-dimensional configuration as a result of the subsequent pivoting apart of the panels of the once-folded basepiece.

Then folding about the horizontal axis 103, as depicted in FIG. 22, is carried out, and a pop-up element 121 is created which is ready for utilization. The upper edges of the twice-folded structure become joined together by the pressure-sensitive adhesive 119 which is exposed along the edge of the rear surface of flag panel 111*b*, thus joining the pair of composite flag panels along the free edge as seen in FIG. 23. The pop-up element 121 is then affixed to one panel 123*a* of a basepiece having a fold-line therein, and the facing panel 123*b* is superimposed on the panel 123*a* to sandwich the pop-up element therebetween, as illustrated in FIG. 24. Thereafter, when the basepiece panels 123*a* and 123*b* are opened, the pop-up element 121 assumes an attention-attracting 3-dimensional orientation because the exposed pressure-sensitive adhesive on the subpanels 113*d* and 113*c*, respectively, affix these subpanels to the basepiece panels 123*a* and 123*b*.

Figure 26:
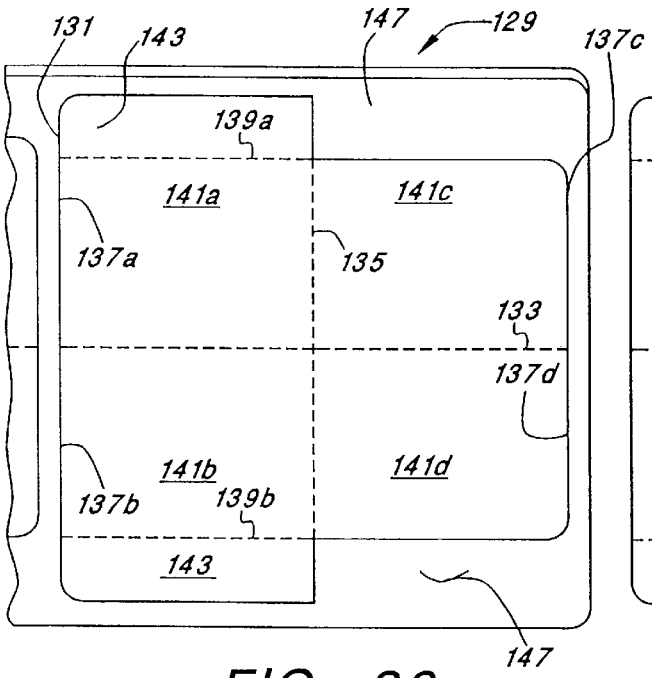
FIG. 26 is a perspective view similar to FIG. 20 showing an alternative embodiment of yet another pop-up item of composite sheet material generally similar to that shown in FIG. 20, which contains a plurality of pop-up structures.

Illustrated in FIG. 26 is a pop-up item 129 in the form of an elongated strip similar to that shown in FIG. 20 having a plurality of pop-up structures 131 formed in the front sheet of composite sheet material. As indicated hereinbefore, the same arrangement could be produced with multiple pop-up structures abreast in a single 8½×11 sheet or in a continuous web of material. As with the previously described embodiments, the pop-up structure 131 is kiss-cut in the front sheet of the composite sheet material. Its design is such that there is general symmetry about a horizontal line of weakness 133; however, the structure is also divided into two generally similar halves by a vertical line of weakness 135. The lines of weakness 133, 135 are perpendicular to each other and create 4 quadrants 137*a,b,c* and *d*. In addition, lines of weakness 139*a* and 139*b* extend across the first and second quadrants 137*a*, 137*b* parallel to the horizontal line of weakness 133 and preferably are spaced equally therefrom. These lines of weakness 139 divide the quadrants 137*a* and 137*b* into respective flag panels 141 and subpanels 143. The proportioning of the pop-up structure is such that the surface area of the quadrants 137*c* and 137*d* is less than that of the other two quadrants as a result of cutouts 147 being provided in what would otherwise be a generally rectangular outline of the structure, which cutouts are located in the regions that are generally aligned with the subpanels 143.

Figure 27:
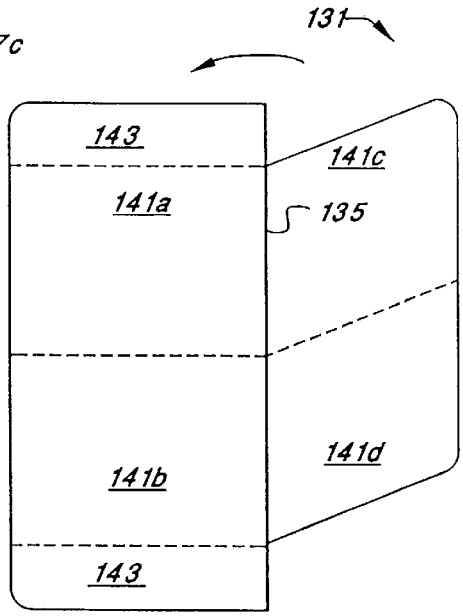
FIG. 27 is a view of the pop-up structure of FIG. 26 removed from the liner sheet and shown as it is being folded about a first vertical fold line.

Removal of the pop-up structure 131 from the rear sheet of the composite sheet material provides the single thickness sheet shown in FIG. 27 which is first folded in half along the vertical line of weakness 135. A pattern of pressure-sensitive adhesive 149 may cover the entire rear surface of the pop-up structure 131 or a striated or other pattern may be provided which is aligned so that the undersurfaces of the subpanels 143 carry a significant amount of pressure-sensitive adhesive. When the folding is complete so that the rear surfaces of the 4 quadrants are in contact with one another, the pressure-sensitive adhesive affixes flag panel 141*a* to flag panel 141*c* and flag panel 141*b* to flag panel 141*d*. Because of the location of the cutouts 147, the undersurfaces of the subpanels 143 which carry the pressure-sensitive adhesive are exposed.

Figure 28:
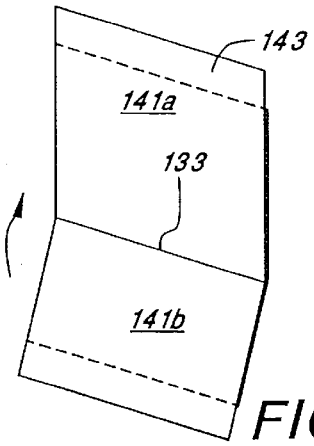
FIG. 28 is a perspective view showing the once-folded pop-up structure of FIG. 27 as it is being folded a second time about a horizontal fold-line.
Figure 29:
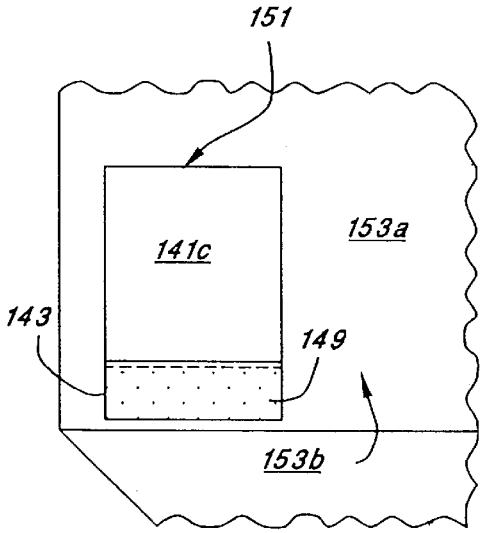
FIG. 29 is a front view showing the folded pop-up element of FIG. 28 placed in operative position adjacent a fold-line on a basepiece having a pair of interconnected panels.
Figure 30:
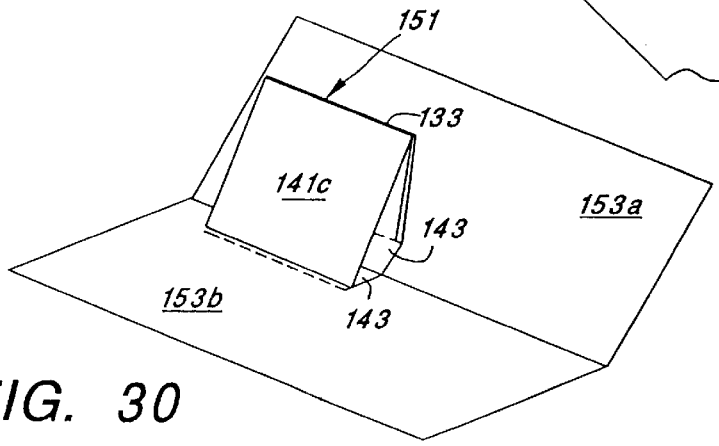
FIG. 30 is a perspective view showing the open panels of the basepiece of FIG. 29 after they were initially folded to sandwich the pop-up element therebetween, which illustrates how the pop-up element assumes an attractive 3-dimensional configuration as a result of the subsequent pivoting apart of the panels of the once-folded basepiece.

Folding about the horizontal axis 133, as depicted in FIG. 28, is then carried out which creates a pop-up element 151 which is ready for utilization. The pop-up element 151 is then appropriately affixed to one panel 153*a* of a basepiece having a fold-line therein, and the facing panel 153*b* is superimposed thereupon to sandwich the pop-up element therebetween as illustrated generally in FIG. 29. Thereafter, when the basepiece panels 153*a* and 153*b* are opened, the pop-up element 151 assumes an attention-attracting 3-dimensional orientation with the adhesive-bearing subpanels 143 affixed appropriately to the opposite basepiece panels 153*a* and 153*b*, as shown in FIG. 30.

Illustrated in FIG. 31 is a pop-up item in the form of an elongated strip having a plurality of pop-up structures 157 formed in the front sheet of composite sheet material; however, it should be understood that this arrangement could be produced with multiple pop-ups abreast in a single 8½×11 sheet or in a continuous web of sheet material, as described hereinbefore. As explained with regard to the previously described embodiments, the pop-up structure 157 is kiss-cut in the front sheet of the composite material. Its design is such that there is general symmetry about a central horizontal line of weakness 159 from the standpoint that, disposed both above and below the line of weakness, there are flag panel sections 161*a* and b which are joined by lines of weakness 163*a* and 163*b* to subpanel sections which are in turn joined to each other along the central line of weakness 159. The lower half includes only a single subpanel 165 which extends laterally to a pair of slits 167, which slits are parallel and vertical, extending to both flag sections 161*a* and 161*b* and crossing all three lines of weakness. The subpanel section of the upper half is divided by the slits 167 into a central section 169 and a pair of side sections 171*a* and *b*. The slits also create four legs 173*a, b, c* and *d* along the lateral edges of each flag section. Finally, a rectangle 175 is die-cut centrally from the central subpanel 169 to create an aperture in this location in the subpanel, through which pressure-sensitive adhesive from the undersurface of the subpanel 165 will ultimately be exposed.

Removal of the pop-up structure 157 from the rear sheet of the composite sheet material provides the single thickness sheet which is then folded about the horizontal line of weakness 159 as depicted in FIG. 32. A pressure-sensitive adhesive pattern across the rear surface of the pop-up structure 157, upon the completion of folding, affixes the flag panels 161*a* and 161*b* to each other, with the legs 173*a* and *c* being joined and with the legs 173*b* and *d* being joined, creating a pop-up element 176. In this folded condition, the pressure-sensitive adhesive on the undersurfaces of the flanking subpanels 171*a* and 171*b* is exposed, and the pressure-sensitive adhesive on the undersurface of the central subpanel 165 is exposed in the region of the die-cut rectangular aperture 175.

When the folded pop-up element 176 is then placed between a pair of basepiece panels 177*a* and 177*b* connected along a fold-line, and sandwiched therebetween, the subpanels 171*a* and 171*b* become secured to the interior surface of the basepiece panel 177*a*, and the central subpanel becomes secured to the basepiece panel 177*b*. When the basepieces are then opened, as depicted in FIG. 33, the pop-up element 176 assumes its 3-dimension attention-attracting configuration.

Illustrated in FIG. 34 is still another pop-up item 181 which is also in the form of an elongated strip having a plurality of pop-up structures 183 kiss-cut in the front sheet of the composite sheet material. As mentioned before, the arrangement could be produced as a part of a web with multiple pop-up structures abreast or in a single 8½×11 inch sheet containing an array of such pop-up structures. The pop-up item 181 is formed from composite sheet material which is different from those previously described because two bands of different adhesive are used. The composite material is formed using what is known as a dry-residue adhesive which covers an upper portion of the sheet, which band is marked with the letter "D" in FIG. 34. The lower portion of the sheet is provided with a pressure-sensitive adhesive pattern as has been discussed hereinbefore, which band is marked with the letter "T".

Kiss-cut in the upper dry-residue adhesive portion of the composite sheet material is a large front section, that includes a flag panel 185, and a much smaller back section located near the bottom. The flag panel has a horizontal line of weakness 187 formed therein, and a vertical slit 189 extends upward from the bottom of the pop-up structure 183 to the line of weakness 187, creating a pair of legs 191*a* and 191*b* in the lower portion of the flag panel. The lower portion of the composite sheet in the region "T", where the pressure-sensitive adhesive pattern is provided, is kiss-cut to provide a pair of subpanels. The upper subpanel includes panels 193*a* and 193*b* which are arranged on opposite sides of the vertical slit 189 and which are respectively connected to the legs 191*a* and 191*b* via a line of weakness 195. The back panel comprises a lower subpanel 197 that resides only on the left-hand side of the slit 189 and is attached via a line of weakness 199 to the subpanel 193*a*.

When the pop-up structure 183 is removed from the composite sheet material, as depicted in FIG. 35, because of the dry-residue adhesive, there is no tacky adhesive on the rear surface of the flag panel 185 or the legs 191, as there is upon the rear surfaces of the subpanels in the region "T". Folding of the back section, i.e. the lower subpanel 197, rearward about the line of weakness 199 is then effected in order to produce the pop-up element 201 shown in FIG. 36. In this configuration, an adhesive region 203 is exposed facing forward in the region below the larger leg 191*a*.

The pop-up element 201 is then affixed in a desired location on a basepiece panel 205*a* adjacent a fold-line 207 as shown in FIG. 36, in which position the pressure-sensitive adhesive on the undersurface of subpanel 193*b* attaches to the interior surface of the basepiece panel 205*a*. Folding of the basepiece about the fold-line 207 to sandwich the pop-up element 201 therebetween completes the affixation as attachment occurs between the lower basepiece panel 205*b* and the rear surface of the subpanel 197 that was originally at the bottom of the structure via the exposed adhesive pattern 203. Opening of the two basepiece panels 205*a* and 205*b* causes the pop-up element 201 to assume its attention-attracting 3-dimensional configuration as shown in FIG. 37. As an alternative, the pop-up structure 183 could be enlarged and made generally symmetrical about the fold-line 199; in which case, a pressure-sensitive adhesive pattern applied across the rear surface would be effective to join two flag panels of the front and back sections to each other as in FIG. 32. Furthermore, if desired, various of these pop-up elements may be affixed directly upon a supporting surface instead of being inserted between a pair of hinged basepieces.

Illustrated in FIG. 38 is a modification of the pop-up structure 183 shown in FIGS. 34–37 wherein, instead of having a subpanel section 197 hinged to the bottom edge of the subpanel 193*a*, at least one hinged subsection is provided in side-by-side arrangement with the subpanel at the bottom end of the major leg. Illustrated is a pop-up structure 183' which would again be formed from a composite sheet wherein there would be dry-residue adhesive on the rear surface of the region wherein the flag panel 185 and the legs 191*a* and 191*b* would be die-cut. However, at the bottom of the wider or major leg 191*a*, a subpanel 207 is formed which has three subsections 207*a*, 207*b* and 207*c*, the rear surfaces of which carry a pressure-sensitive adhesive pattern, as does the rear surface of the subpanel 193*b* that is hinged to the bottom of the leg 191*b*. The central subpanel section 207*b* is hinged to the bottom of the major leg 191*a*, and the subsections 207*a* and 207*c* are connected only by vertical hinge lines to the central subpanel 207*b*. To prepare the pop-up structure for installation, one of the subpanel subsections, preferably the subsection 207*a*, is folded forward so as to be superimposed on the front surface of the subpanel 207*b* and present a forward-facing pressure-sensitive adhesive panel, and the other subsection 207*c* is folded 180° rearward so as to cover the pressure-sensitive adhesive on the rear surface of the central subpanel 207*b*. The pop-up structure 183' can then be placed between the panels of a folding basepiece as in FIG. 36 and will, upon opening, assume the attention-attracting orientation as shown generally in FIG. 37. A further alternative modification employs only a single side-by-side subsection having a width, for example, twice that of the subpanel section 207*b* that is hinged to the bottom of the main leg. Then, as a result of the singular rearward folding of such a wider section, the pressure-sensitive adhesive on the rear surface of the subpanel 207*b* would be similarly obscured while the additional width would create an extension that would extend beyond the opposite vertical edge of the subpanel 207*b* and provide the desired forward-facing pressure-sensitive adhesive region.

Figure 39:
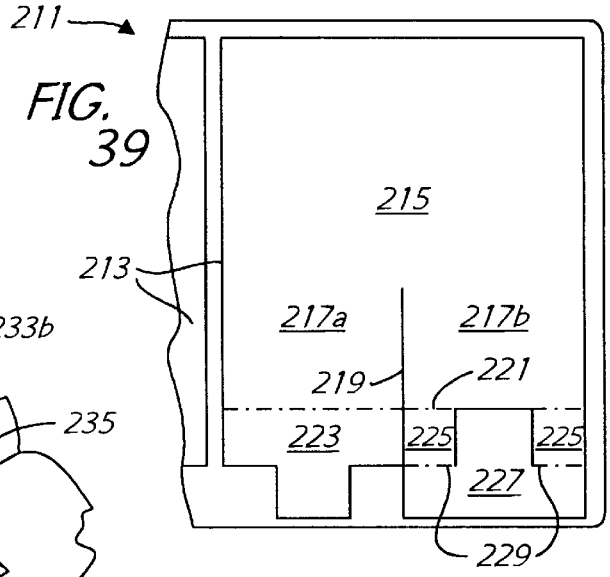
FIG. 39 is a front view generally similar to FIG. 34 showing yet another alternative embodiment of a pop-up item made of composite sheet material which also utilizes a combination of dry-residue adhesive and pressure-sensitive adhesive.

Illustrated in FIG. 39 is yet another pop-up item 211 which is in the form of an elongated strip of composite sheet material having a plurality of pop-up structures 213 kiss-cut in the front sheet thereof. A similar arrangement could be produced as part of a single 8½×11 sheet or as a web having multiple pop-up structures abreast of each other. The pop-up item 211 is formed from composite sheet material similar to that used to form the pop-up item 181 described hereinbefore. An upper major band of dry-residue adhesive may cover all or a portion of the upper half of the sheet, whereas the lower portion below a hinge line to be described hereinafter is provided with a pressure-sensitive adhesive pattern which may be a full coating across the entire rear surface.

The kiss-cut pop-up structure 213 includes a main upper flag section 215 and a base section which includes a pair of legs 217*a* and 217*b* which are separated from each other by a slit 219. Subpanels are hinged to the lower edges of the legs 217*a* and 217*b* along an optional line of weakness 221 which extends generally across the pop-up structure perpendicular to the slit 219, or at a slight angular offset therefrom if desired. The dry residue adhesive region lies above the line of weakness 221, and the pressure-sensitive adhesive region lies below it. A T-shaped subpanel 223 is hinged to the bottom of the leg 217*a*, and a pair of rectangular, e.g. square, subpanels 225 are hinged along the line 221 to the leg 217*b*. These two subpanels 225 are in turn hinged along a fold-line 229 to a panel 227 having the shape of an inverted T, which is referred to as a rear panel because of its disposition in the ultimate pop-up element.

Figure 40:
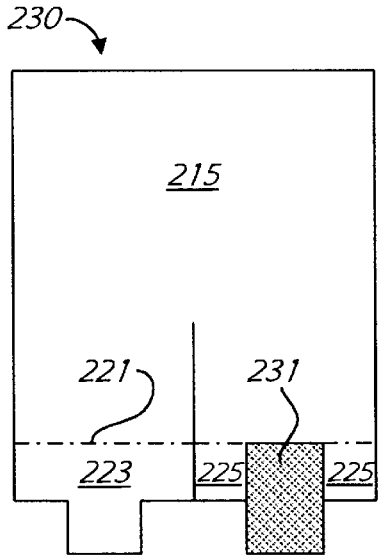
FIG. 40 is a front view of one pop-up structure from FIG. 39 with one subpanel folded rearward about a pair of horizontal fold lines.

When the pop-up structure 213 is removed from the composite sheet material, as depicted in FIG. 40, because of the dry-residue adhesive there is no tacky adhesive on the rear surface of the flag panel 215 or the legs 217*a* and 217*b*, as there is upon the rear surfaces of the subpanels 223 and 225 and the rear panel 227. Folding of the rear panel along the fold-lines 229 is then carried out in order to produce the pop-up element 230 illustrated in FIG. 40 wherein an adhesive region 231 faces forward below the leg 217*b*, whereas the pressure-sensitive adhesive on the rear of the square subpanels 225 is now covered by the superimposed portions of the rear panel 227.

Figure 41:
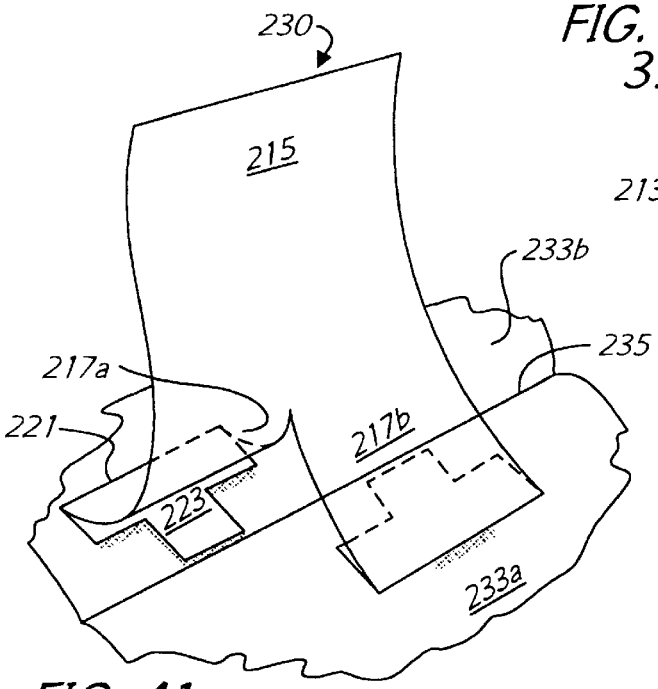
FIG. 41 is a perspective view similar to FIG. 37 showing the arrangement of the pop-up structure of FIG. 40 following attachment to a folded basepiece and the subsequent unfolding thereof.

The pop-up element 230 is then affixed in a desired location between a pair of hinged basepiece panels 233*a* and 233*b*, which may be halves of a single folded sheet, in a location adjacent a fold-line 235 so that the pressure-sensitive adhesive on the rear surface of the T-shaped subpanel 223 affixes it to the basepiece 233*b*, and the exposed adhesive region 231 affixes the rear panel 227 and the connected subpanels 225 to the basepiece 233*a*. Opening of the two basepieces 233*a* and 233*b* causes the pop-up element 230 to assume its attention-attracting three-dimensional configuration as shown in FIG. 41. Alternatively, the pop-up element 230 may be placed on any desired supporting surface by manipulating subpanels 223 and 225 with panel 227 along the line of weakness 221 to have opposite orientations and then affixing one subpanel before the other.

Figure 42:
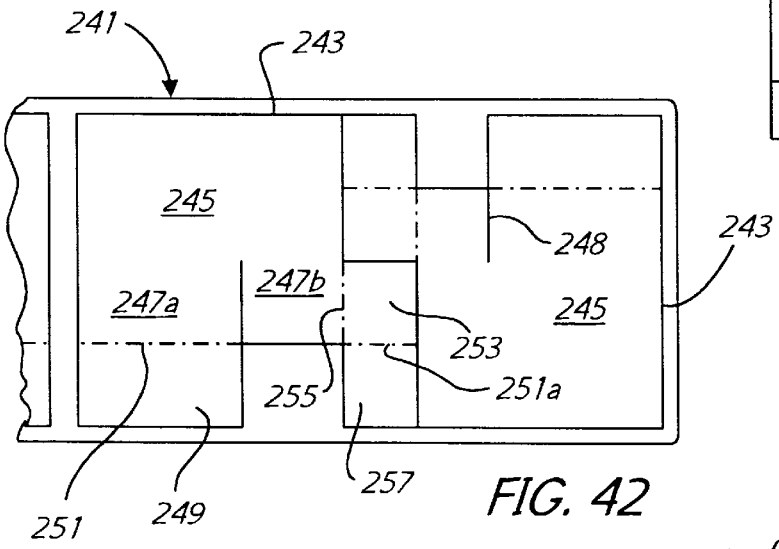
FIG. 42 is a front view of another alternative embodiment of a pop-up item made of composite sheet material generally similar to FIG. 39.
Figure 43:
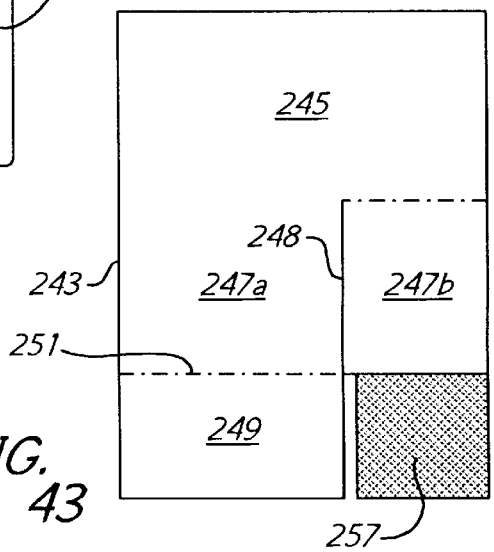
FIG. 43 is a view similar to FIG. 40 showing one pop-up structure of FIG. 42 removed from the composite sheet and having a panel folded rearward about a vertical fold-line.

Illustrated in FIG. 42 and 43 is a modification of the pop-up structure 213 which is designed so it can be fabricated in a nested relationship in pairs where the rear panel is hinged to a lateral edge of one leg. A pop-up item 241 is shown which is a composite sheet in which there has been die-cut a pair of nested pop-up structures 243. Each of the two structures contains a main front panel 245 with a base section in the form of a pair of legs 247*a* and 247*b* separated by a slit 248. A hinged subpanel 249 is interconnected with the leg 247*a* along a line of weakness 251, whereas a rear panel 253 is hinged along a vertical fold-line 255 to a lateral edge of the leg 247*b*. The rear panel 253 includes a line of weakness 251*a* which is co-linear with the hinge line 251 and defines a subpanel 257. The composite sheet material carries pressure-sensitive adhesive in the region below the lines of weakness 251, 251*a*, and it releases to the rear surface of the front sheet upon separation.

When the pop-up structure 243 is removed from the composite sheet and the rear panel is folded along the fold-line 255 and superimposed upon the rear surface of the leg 247*b* (see FIG. 43), a pop-up element is created similar to that shown in FIGS. 39-41 with pressure-sensitive adhesive on the subpanel 257 of the leg 247*b* facing forward and the pressure-sensitive adhesive on the subpanel 249 of the leg 247*a* facing rearward. In this condition, the pop-up element is ready to be placed adjacent a hinge line between a pair of hinged basepieces as described hereinbefore. If desired, the pressure-sensitive adhesive can be extended upward above the hinge line 251*a*, or alternatively provided as a vertical strip throughout the composite material covering the rear panels of both nested pop-up structures so that, upon rotating the rear panel 180° about the fold-line 255, it will adhere to the rear surface of the leg in this orientation. As another alternative, a pattern of coadhesive having a light tack could be used instead of dry residue adhesive in the upper portion of the composite sheet material, which coadhesive covered surfaces would bond firmly when the rear panel 253 is folded onto the rear surface of the leg 247*b*.

Figure 44:
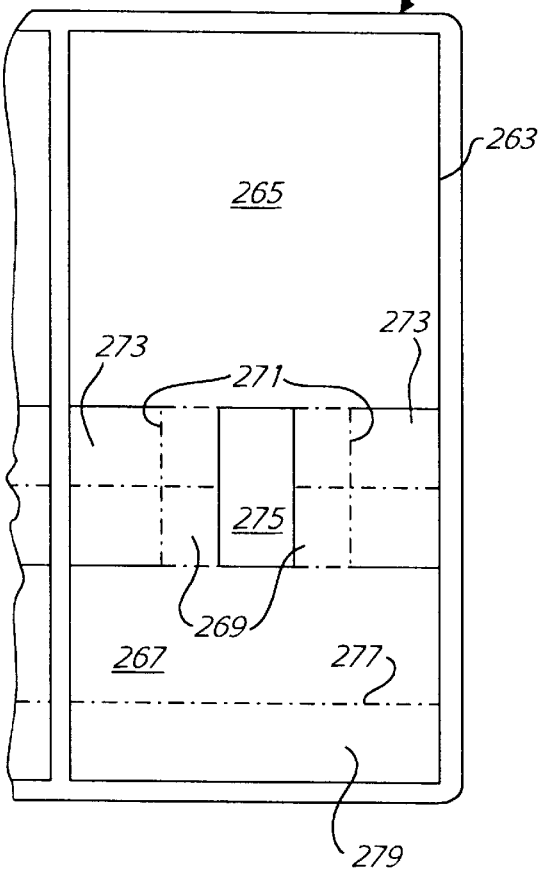
FIG. 44 is a front view generally similar to FIG. 31 showing a further alternative embodiment of a pop-item of composite sheet material which contains a plurality of pop-up structures, each having two flag panels.

Depicted in FIGS. 44–47 is a further alternative type of pop-up arrangement where there is an interconnection between a pair of oppositely facing flag panels which would permit both flag panels to carry a printed message as a result of printing only on one surface of the composite sheet material. More specifically, FIG. 44 shows a pop-up item 261 in the form of composite sheet material in which a plurality of pop-up structures 263 are kiss-cut, arranged in side-by-side relationship. Each pop-up structure 263 includes a main flag panel section 265 and a subsidiary flag panel section 267 which may be smaller in size, as illustrated, or may be of essentially the same size. Located between the flag panels 265, 267 is a base section which includes a pair of legs 269, with a rear panel 273 being hinged along a fold-line 271 to each leg. A rectangular aperture 275 is kiss-cut essentially within the base section between the pair of legs 269. A horizonal line of weakness 277 is provided in the secondary flag panel to create a flange subpanel 279.

Figure 45:
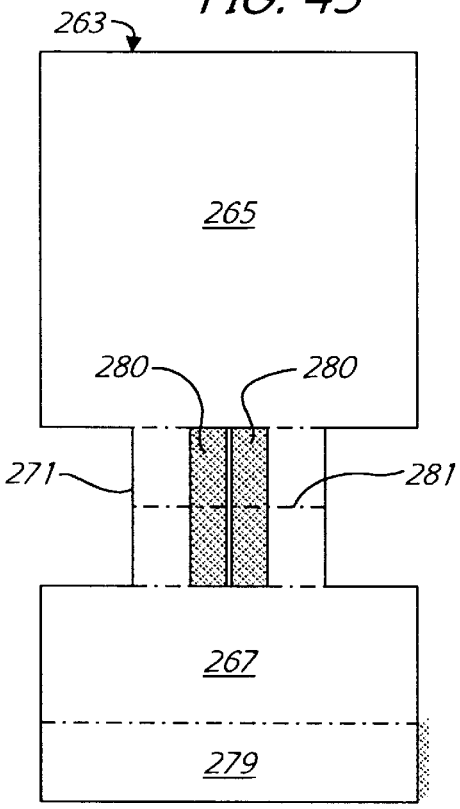
FIG. 45 is a front view of one pop-up structure from FIG. 44 following its removal from the composite sheet and the folding of a pair of panels about vertical fold-lines.
Figure 46:
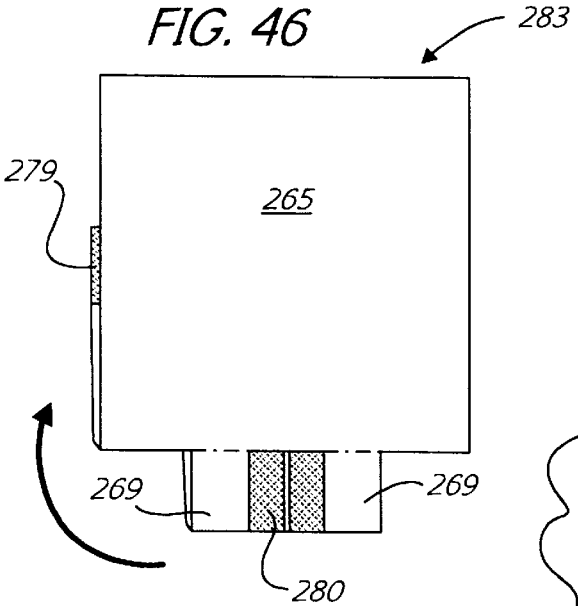
FIG. 46 is a front perspective view showing the pop-up structure of FIG. 45 following its folding about a horizontal line of weakness so as to interconnect facing surfaces of the flag panels to each other and form a pop-up element.

When the pop-up structure 263 is removed from the composite sheet and the rear panels 273 are rotated 180° rearward, pivoting about the fold-lines 271 so as to be superimposed on the rear surfaces of the legs 269, pressure-sensitive adhesive in the regions 280 aligned with the aperture 275 is now exposed as depicted in FIG. 45. Preferably, the construction of the composite sheet material is such that there is dry residue adhesive coated upon the rear surface of the flag panel 265 and the rear surface of the supplementary flag panel 267 above the line of weakness 277, and there is pressure-sensitive adhesive in the region of the legs 269, the rear panels 273 and the flange panel 279. After the rear panels are rotated into the position shown in FIG. 45, the structure 263 is folded about a horizontal line of weakness 281 which essentially divides the legs 269 into halves to form the pop-up element 283 shown in FIG. 46 wherein the flange panel 279 is fixed to the rear surface of the main flag panel 265.

Figure 47:
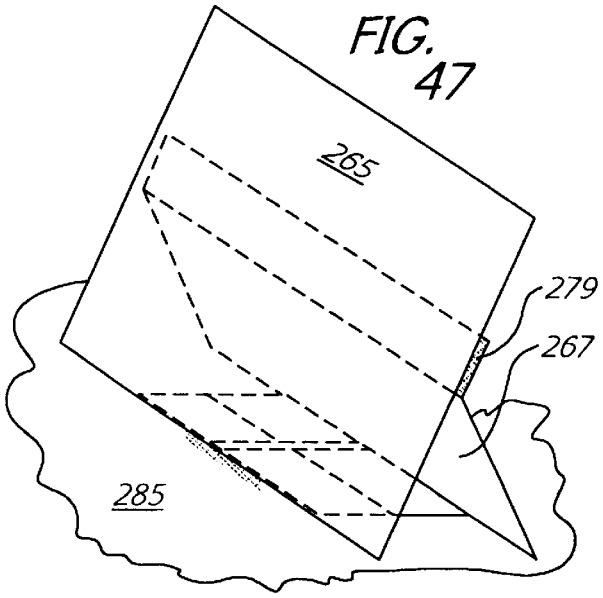
FIG. 47 is a perspective view of the pop-up element of FIG. 46 in its attention-attracting three-dimensional configuration attached to a supporting surface.

In this form, the pop-up element 283 can be inserted between a pair of folded basepieces along a fold-line as hereinbefore described or alternatively can be affixed to a supporting surface 285, as shown in FIG. 47, by simply pressing the pop-up element directly vertically downward. This causes the legs 269 to spread apart and assume a planar configuration while the exposed pressure-sensitive adhesive regions 280 of the associated rear panels 273 become firmly affixed to the supporting surface 285. This placement causes the lower edges of the flag panels 265, 267 to be spread apart so that the pop-up element 283 assumes the attention-attracting, three-dimensional configuration shown in FIG. 47.

Figure 48:
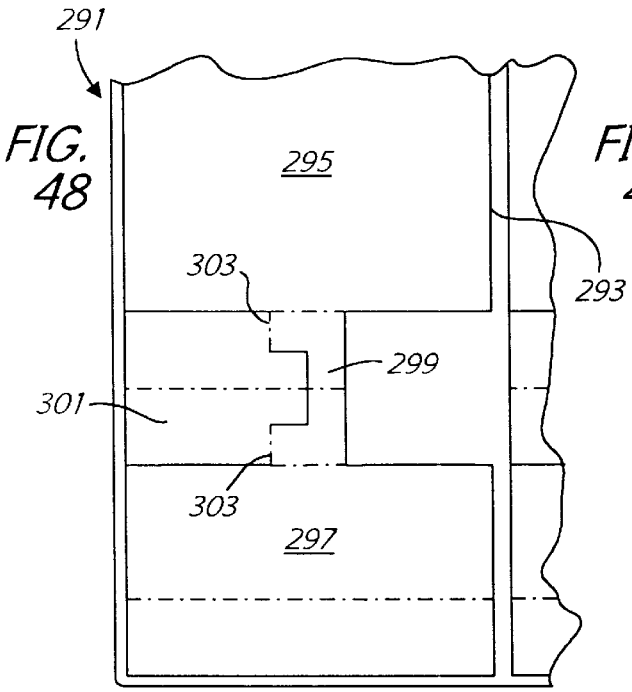
FIG. 48 is a view similar to FIG. 44 of still another alternative embodiment of a pop-up item made of composite sheet material which contains a plurality of pop-up structures.
Figure 49:
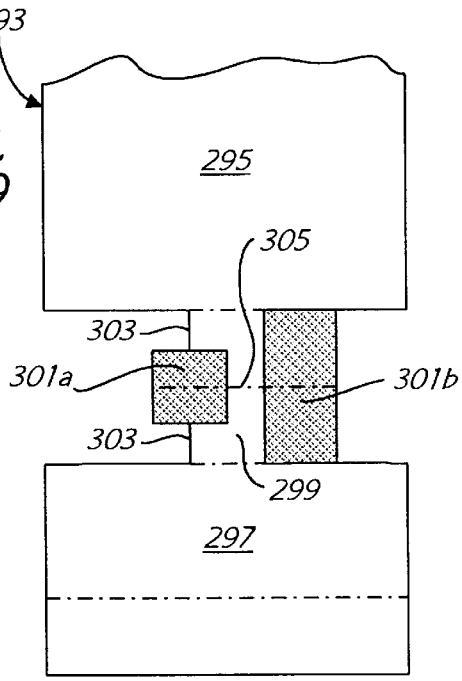
FIG. 49 is a view similar to FIG. 45 showing one pop-up structure from FIG. 48 following the folding of a panel about a pair of spaced apart co-linear vertical lines.

Illustrated in FIGS. 48 and 49 is a pop-up arrangement generally similar to that just described with respect to FIGS. 44–47. Kiss-cut in composite sheet material to create a pop-up item 291 are a plurality of pop-up structures 293, each of which includes a main flag panel 295 and a supplementary flag panel 297 (which may be the same as the panels 265 and 267) between which there is disposed a modified base section. The base section includes a single leg 299 of generally C-shape to which a rear panel 301 is hinged along a pair of co-linear fold-lines 303. When the pop-up structure 293 is removed from the composite sheet and the rear panel 301 is rotated 180° about the vertical fold-lines 303 as shown in FIG. 49, the pressure-sensitive adhesive on the rear surface of the rear panel section 301 of the base section now faces forward, securing the rear panel in surface-to-surface contact with the rear surface of the leg 299 and exposing one rectangular region 301*a* of the adhesive-carrying surface, which lies to the left of the leg, and another larger rectangular section 301*b* of the surface, which lies to the right of the leg 299. With the rear panel 301 rotated into the position as shown in FIG. 49, the structure can be folded about a horizontal line of weakness 305, as described with respect to the pop-up structure of FIGS. 45 and 46, to create a pop-up element which in its display configuration will closely resemble that shown in FIG. 47.

Figure 48A:
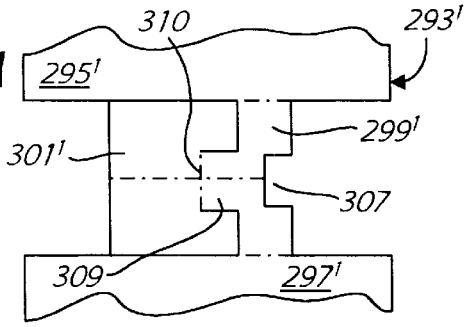
FIGS. 48A and 49A are fragmentary views similar to FIG. 49 which show yet another alternative embodiment of a pop-up structure of this type.
Figure 49A:
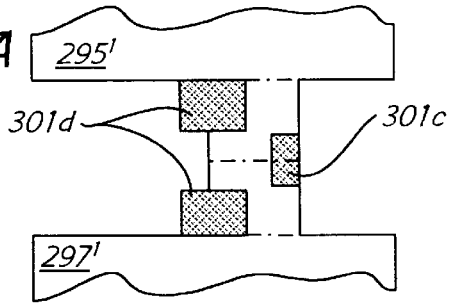

Illustrated in FIGS. 48A and 49B is a pop-up arrangement having a further modified base section compared to that depicted in FIGS. 48 and 49. FIG. 48A is a fragmentary view of the modified structure 293', following its removal from the composite sheet, which includes a main flag panel 295' and a secondary flag panel 297', essentially the same as those previously described. A single leg 299' is provided in the base section which has an aperture 307 formed centrally of its right-hand edge and a projection 309 of rectangular shape formed along its left-hand edge. A rear panel 301' is hinged along a fold-line 310 that forms the left-hand edge of the projection 309. When the rear panel 301' is rotated 180° about the fold-line 310 so that it becomes affixed to the rear surface of the leg 299', as shown in FIG. 49A, a surface region 301*c* is exposed along the right-hand edge of the leg 299', and a pair of rectangular surface regions 301*d* are exposed along the left-hand edge of the leg 299' which function to secure the completed pop-up element either to a pair of facing basepieces or to a supporting surface as described hereinbefore.

Figure 50:
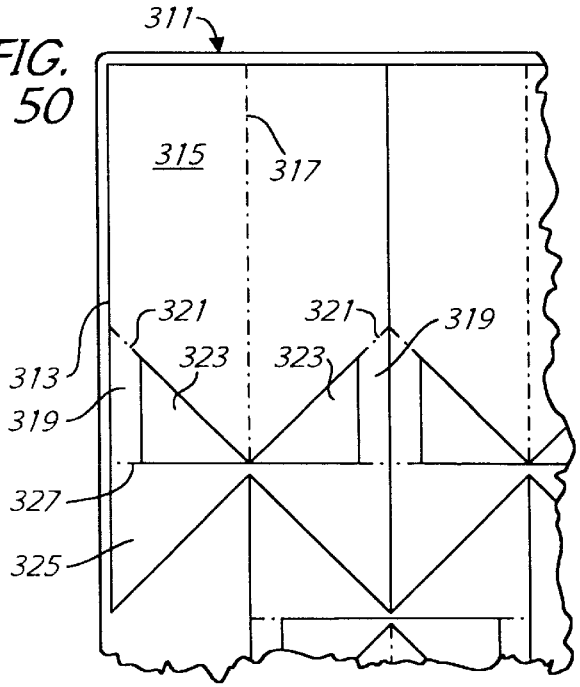
FIG. 50 is a front view similar to FIG. 39 showing one more alternative embodiment of a pop-up item of composite sheet material which contains a plurality of pop-up structures which provide pop-up elements functionally similar to that shown in FIGS. 1–6.
Figure 51:
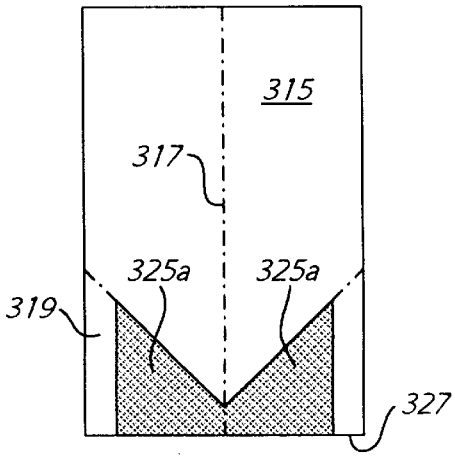
FIG. 51 is a front view of one pop-up structure of FIG. 50 after its removal from the composite sheet and folding of a lower panel.

Illustrated in FIGS. 50 and 51 is a pop-up arrangement that is a modified version of that depicted in FIGS. 1 through 6 and FIGS. 11 and 12. FIG. 50 illustrates a pop-up item 311 in which there is kiss-cut in a composite sheet i.e., front and rear sheets joined together by adhesive like the adhesive 19 shown in FIG. 1A, a plurality of pop-up structures 313 which include a front panel section 315, similar to the flag section 27 of FIG. 3, in which a vertical line of weakness 317 is formed. A pair of legs 319 are provided along the outer lateral edges of the structure which are respectively hinged to the lower edge of the flag panel section 315 along lines of weakness 321. An aperture region is provided between the legs 319 in the form of a pair of triangular apertures 323. A rear panel section 325 is provided at the bottom of the structure 313; it is hinged along a fold-line in the form of a pair of colinear line segments 327 at the bottom of the legs 319.

The rear panel may be in the form of a pair of facing triangular segments, as shown, which facilitate more economical use of material by kiss-cutting a plurality of such structures 313 arranged above and below one another, offset by one-half width. Alternatively, a rectangular rear panel could be employed which would preferably be provided with a pair of lines of weakness at the locations of the present central edges and with a central line of weakness co-linear with the line 317. In either case, the rear surface of the structure lying above the fold-line 327 may be coated with dry residue adhesive or the like as previously discussed, with respect to the region D in FIG. 34 and the rear panel 325 would be coated with pressure-sensitive adhesive. The rear panel is then rotated 180° about the horizontal fold-line 327 so that it becomes affixed to the rear surface of the remainder of the structure 313 and particularly to the legs 319 as a result of the pressure-sensitive adhesive which it carries. As shown in FIG. 51, in this orientation, a pair of triangular regions 325*a* of pressure sensitive adhesive are exposed in the aperture region and are thus available for affixation of the pop-up element between a pair of basepieces or upon any desired supporting structure. The structure shown in FIG. 51 is then folded in half along the vertical fold-line 317 and used as described with respect to the pop-up element illustrated in FIGS. 4, 5 and 6.

Although the invention has been described with regard to certain preferred embodiments, it should be understood that various changes and modifications as would be obvious to one having the ordinary skill in this art may be made without departing from the scope of the invention which is set forth in the claims appended hereto. For example, although fabrication from single sheets is illustrated, it should be understood that these sheets can be of any desired size, and they may be sheets that are designed to facilitate personalized imprinting via EDP. Moreover, a continuous web or roll of composite sheet material can be employed, and one or more die-cut (kiss-cut) pop-up structures can be arranged across the width of such a continuous roll. Likewise, although actual lines of weakness are preferred for fold-lines so as to facilitate the folding and to also facilitate the sharp bending of the ultimate pop-up element in its final form, such lines can be omitted or simply printed upon the surfaces of the pop-up structure if desired, relying upon the inherent flexibility of the fibrous sheet material or the like to permit folding to occur where desired.

Instead of using a complete pressure-sensitive adhesive pattern as is commonly employed in the label art today, suitable overall regular patterns, such as spaced-apart parallel strips of pressure-sensitive adhesive, can alternatively be employed so long as registration of the die-cutting is enabled in order to assure that the ultimately exposed surfaces of the subpanels will carry the desired pressure-sensitive adhesive. As an alternative to providing dry residue adhesive on a portion of the composite sheet material and a pressure-sensitive adhesive pattern on other portions of the composite sheet material, two different grades of sheet material having distinctly different characteristics for the facing sheet surfaces may be used so as to facilitate the application of a pressure-sensitive adhesive pattern throughout. By selecting sheet material having different surface characteristics such that pressure-sensitive adhesive would have a greater or a lesser tendency to adhere thereto, such a pressure-sensitive adhesive pattern may be used throughout for the pop-up items described with respect to FIGS. 34 to 38 and for other of the embodiments in FIGS. 39–51. For example, a rear sheet could be employed having a surface to which pressure-sensitive adhesive would preferentially adhere as compared to the rear surface of the front sheet. Then, by coating preselected regions of that rear sheet with a release material, such as a polysilicone coating, when the pop-up structure that is kiss-cut in the front sheet is separated, pressure-sensitive adhesive would release from the rear sheet only in those preselected regions where the release coating was applied. As a result, only selected regions of the separated pop-up structure, as described with respect to FIGS. 31–51, would carry pressure-sensitive adhesive on the undersurface thereof.

Although the term "pop-up" element is used throughout to refer to the illustrated sheet material structures, it is intended to broadly encompass any flat sheet material structures that are easily displayable in 3-dimensional form as a result of the pressure-sensitive adhesive provided on the subpanel surfaces thereupon.

In addition to being able to efficiently provide a message or other image on opposite-facing panels of a flag unit, the invention facilitates providing personalization in both message and in placement of pop-up elements, as compared to other machine-made pop-ups which are generally fabricated on a mass-production basis where the message is imparted to the sheet material before the adhesive necessary to create the 3-dimensional pop-up is added. Thus, this versatility of the pop-up structures provided by the present invention can be of significant advantage in being able to target personalized markets or the like.

Particular features of the invention are emphasized in the claims that follow.

What is claimed is:

1. A pop-up item (311), which comprises a front sheet having a front surface and a rear surface, a rear sheet, and adhesive attaching said front and rear sheets to each other so that they can be separated without damage to either of said sheets, said rear sheet having a front surface having releasing characteristics over at least part of its area so that pressure-sensitive adhesive located in the area will adhere to the rear surface of said front sheet when said front and rear sheets are separated from each other, said front sheet having die-cut therein a pop-up structure (313) that contains a main front panel (315) that is connected along a fold-line (327) with a rear panel (325) having a different size and shape than said front panel (315), said front panel including a flag panel section and a base section that includes at least two legs (319) and a pair of die-cut apertures (323) of generally triangular shape, said legs being hinged to said flag panel section, and said pop-up structure having a pressure-sensitive adhesive coating on at least a portion of said rear surface in a region of said rear panel (325), said flag panel section being formed with a central line of weakness (317) that extends perpendicular to said fold-line (327), and said base section legs (319) being respectively hinged to said front panel section at angles of between about 30° and 60° to said central line of weakness, so that, following separation of said die-cut pop-up structure (313) entirely from said rear sheet to expose said pressure-sensitive adhesive upon its rear surface, said die-cut pop-up structure can be folded along said fold-line (327) to superimpose said rear panel (325) upon said rear surface of said main front panel and affix one to the other and create a pop-up element of planar configuration including said flag panel section and said base section, with said rear panel having an associated exposed surface of generally triangular shape which carries pressure-sensitive adhesive **(325*a*)** located at each said aperture, whereby said pop-up element can be affixed to a supporting surface or to a pair of hinged-together panels in a manner that said pop-up element assumes a three-dimensional configuration.

2. The pop-up item according to claim 1 wherein said rear panel (325) is hinged to an edge of one of said legs, and wherein said pressure-sensitive adhesive, which attaches said front and rear sheets, covers substantially the entire rear surface of said rear panel (325).

3. The pop-up item according to claim 2 wherein each of said legs (319) includes a hinged subpanel.

4. The pop-up item according to claim 1 wherein said rear panel (325) is hinged to lower edges of said legs (319) along said fold-line (327).

5. A pop-up item, which comprises a front sheet having a front surface and a rear surface, a rear sheet, and adhesive attaching said front and rear sheets to each other so that they can be totally separated from each other without damage to either of said sheets, said rear sheet having a front surface having releasing characteristics over at least a preselected area and pressure-sensitive adhesive being located in at least some of said preselected area so that said pressure-sensitive adhesive will adhere to the rear surface of said front sheet when said front and rear sheets are separated from each other, said front sheet having die-cut therein a pop-up structure that contains a main panel having a leg portion and an aperture region with said leg portion including a pair of parallel legs and said aperture region being located between said parallel legs and at least one panel connected thereto along a fold-line, said at least one panel having a different size and shape than said main panel, and the rear surface of said at least one panel carrying at least some of said pressure-sensitive adhesive, and said at least one panel being hinged to an edge of said leg portion of said main panel along said fold-line, so that, following separation of said die-cut pop-up structure entirely from said rear sheet to expose said pressure-sensitive adhesive upon said rear surface of said front sheet, said at least one panel can be folded rearward 180° about said fold-line so that there is surface-to-surface contact between said at least one panel and said rear surface of said main panel to create a pop-up element of planar configuration with at least some of said pressure-sensitive adhesive on said one at least panel being exposed through said aperture region and facing forward, whereby said pop-up element can be affixed to a supporting surface or to a pair of hinged-together panels in such a manner that said pop-up element assumes a three-dimensional configuration.

6. The pop-up item according to claim 5 wherein said fold-line extends along a lateral edge of said leg portion.

7. A pop-up item, which comprises a front sheet having a front surface and a rear surface, a rear sheet, and adhesive attaching said front and rear sheets to each other so that they can be separated without damage to either of said sheets, said rear sheet having a front surface having releasing characteristics over at least part of its area so that pressure-sensitive adhesive located in the area will adhere to the rear surface of said front sheet when said front and rear sheets are separated from each other, said front sheet having die-cut therein a plurality of pop-up structures each of which contains a main front panel that has a rear panel section connected thereto along a fold-line, said rear panel section having a different shape and is smaller in size than said front panel, said front panel including two flag panel sections which have a common edge, along which said flag panel sections are hinged to each other, and a pair of parallel legs, each of said legs being hinged at one end to one of said flag panel sections and at another end to said rear panel section, and said legs being separated by an aperture region, said pop-up structure having a pressure-sensitive adhesive coating on said rear surface of said rear panel section, so that, following separation of one of said die-cut pop-up structures entirely from said rear sheet to expose said pressure-sensitive adhesive upon its rear surface, said die-cut pop-up structure can be folded along said fold-line to superimpose said rear panel section upon said rear surface of said main front panel and create a pop-up element of planar configuration including said two hinged flag panel sections and said parallel legs, with said pressure-sensitive adhesive being exposed through said aperture region, whereby said pop-up element can be affixed to a supporting surface or to a pair of hinged-together panels in a manner that said pop-up element assumes a three-dimensional configuration.

8. The pop-up item according to claim 7 wherein said flag panel sections are hinged to each other along a longitudinal line of weakness, and wherein said pressure-sensitive adhesive covers substantially the entire rear surface of said rear panel section and is exposed through two triangular apertures provided by said aperture region.

* * * * *